US010018943B2

(12) United States Patent
Sakamaki

(10) Patent No.: US 10,018,943 B2
(45) Date of Patent: Jul. 10, 2018

(54) DEVELOPING SLEEVE AND DEVELOPING DEVICE

(71) Applicant: CANON KABUSHIKI KAISHA, Tokyo (JP)

(72) Inventor: Tomoyuki Sakamaki, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/444,534

(22) Filed: Feb. 28, 2017

(65) Prior Publication Data

US 2017/0255132 A1 Sep. 7, 2017

(30) Foreign Application Priority Data

Mar. 2, 2016 (JP) ..... 2016-040383

(51) Int. Cl.
*G03G 15/09* (2006.01)

(52) U.S. Cl.
CPC ..... *G03G 15/0928* (2013.01)

(58) Field of Classification Search
USPC ..... 399/119, 252, 265, 267, 276
See application file for complete search history.

(56) References Cited

U.S. PATENT DOCUMENTS

| | | | | |
|---|---|---|---|---|
| 4,982,689 | A | 1/1991 | Honda et al. | |
| 6,925,277 | B2 * | 8/2005 | Sugihara | G03G 9/1134 399/267 |
| 9,052,634 | B2 | 6/2015 | Furukawa et al. | |
| 9,235,158 | B2 * | 1/2016 | Ishida | G03G 15/0812 |
| 2013/0136506 | A1 | 5/2013 | Sakamaki | |
| 2015/0104220 | A1 | 4/2015 | Sakamaki et al. | |

FOREIGN PATENT DOCUMENTS

| | | | |
|---|---|---|---|
| JP | H02-50182 | A | 2/1990 |
| JP | 2003-330262 | A | 11/2003 |
| JP | 2007-025462 | A | 2/2007 |
| JP | 2007-093705 | A | 4/2007 |
| JP | 2010-217237 | A | 9/2010 |

* cited by examiner

*Primary Examiner* — Hoan Tran
(74) *Attorney, Agent, or Firm* — Fitzpatrick, Cella, Harper & Scinto

(57) ABSTRACT

A developing sleeve includes first axially extending groove portions which satisfy $D_1 \geq 2R$ and $W_1 \geq 2R$, where 2R is a volume-average particle size of a carrier, $D_1$ is a maximum depth of each first groove portion and $W_1$ is a width an opening of each first groove portion with respect to a circumferential direction of the developing sleeve, and second axially extending groove portions. Each second groove portion satisfies $D_2 < 2R$, where 2R is the volume-average particle size of the carrier and $D_2$ is a maximum depth of each second groove portion. Each or a plurality of the second groove portions are disposed between the first groove portions with respect to the circumferential direction of the developing sleeve.

62 Claims, 14 Drawing Sheets

(a)

(b)

(a)

(b)

(a)

(b)

(a)

(b)

(a)

(b)

(a)

(b)

(c)

(a)

(b)

(a)

(b)

DEVELOPING SLEEVE AND DEVELOPING DEVICE

FIELD OF THE INVENTION AND RELATED ART

The present invention relates to a developing device for use with an image forming apparatus of an electrophotographic type, an electrostatic recording type, or the like, and particularly relates to a developing device for use with an image forming apparatus using a two-component developer which is a mixture of non-magnetic toner and a magnetic carrier.

A conventional image forming apparatus of an electrophotographic type has been widely used as a copying machine, a printer, a plotter, a facsimile machine, a multifunction machine having a plurality of functions of these machines, and the like. In the image forming apparatus, as the developer, the two-component developer which is the mixture of the non-magnetic toner and the magnetic developer has become widespread. In the developing device of the image forming apparatus using the two-component developer, the developer is fed to the neighborhood of a photosensitive drum while being magnetically attracted to a rotating developer carrying member (hereinafter referred to as a developing sleeve). As a result, an electrostatic latent image on the photosensitive drum can be developed and visualized with the toner in the developer. In this developing device, a magnet fixedly provided to a casing is disposed inside the rotating developing sleeve, and the developer is held on a surface of the developing sleeve by a magnetic force. Further, in the developing device, a regulating blade which is a regulating member provided opposed to the developing sleeve with a predetermined interval therebetween is provided, and the developer is fed on the developing sleeve to the neighborhood of the photosensitive drum while being regulated to have a desired developer amount in general.

In recent years, the copying machine and the printer are high in demand for high image quality, high reliability and high stability. In order to satisfy these demands, stability of the amount of the developer on the developing sleeve with time is important. For this reason, as the developing sleeve, a developing sleeve having a surface portion where unevenness is formed by sandblasting with abrasive grain has been known. In general, on the developing sleeve subjected to the sandblasting, in order to prevent deformation of the developing sleeve during processing (machining), the unevenness is formed in a state in which an amount thereof is relatively small. For this reason, there is a liability that the surface unevenness is abraded by use of the developing sleeve for a long time, and thus not only developer feeding power lowers and becomes unstable but also a lifetime of the developing device is shortened.

In order to solve this problem, as the developing sleeve, a developing sleeve having a surface portion provided with a plurality of grooves extending in parallel with a rotational axis thereof has become widespread (Japanese Laid-Open Patent Application (JP-A) Hei02-50182). In this developing sleeve, the grooves are formed by dies through drawing or the like, so that a level difference of the unevenness can be increased without deforming the developing sleeve as in the case of the sandblasting. For that reason, compared with the developing sleeve subjected to the sandblasting, the developing sleeve is not readily influenced by the abrasion in the use thereof for a long time, so that stabilization of the developer feeding power is possible.

Further, also a developing sleeve on which in place of the grooves, a plurality of recessed portions where magnetic carrier particles enter are uniformly formed has been proposed (JP-A 2007-93705). Also in this developing sleeve, similarly as the developing sleeve provided with the grooves, compared with the developing sleeve subjected to the sandblasting, the level difference of the unevenness can be increased without being, so that the developer feeding power can be stabilized.

However, in the above-described developing sleeve of JP-A Hei02-50182, the level difference of the unevenness of the surface grooves is excessively high, and therefore unless a gap (SB gap) between the developing sleeve and the regulating blade is decreased, the amount of the developer on the developing sleeve increases. For this reason, there arises a problem such that the gap between the developing sleeve and the regulating blade has to be decreased.

Particularly, as regards the demand for the high image quality, in order to avoid deterioration of graininess due to sliding between the developer on the developing sleeve and a toner image formed on the photosensitive drum to the extent possible, in recent years, there is a tendency to decrease the amount of the developer on the developing sleeve. As regards a demand for formation of a thin layer of the developer on the developing sleeve described above, the gap between the developing sleeve and the regulating blade has a tendency to further decrease. However, when the gap between the developer and the regulating blade is excessively made small, there is a liability that the regulating blade portion is clogged with a foreign matter and impairs a coated state of the developer on the developing sleeve.

On the other hand, in order to increase the gap between the developing sleeve and the regulating blade, when a depth of the grooves is shallowed, the feeding power lowers, so that there is liability that the coated state becomes unstable or the developing sleeve is not coated with the developer. Further, also by decreasing the number of the grooves on the surface of the developing sleeve, the gap of the regulating blade can be increased, but in this case, density non-uniformity due to a groove pitch liable to appear on an image. This is because the number of the grooves decreases and the developer is liable to stagnate at the groove portions and because an interval between adjacent grooves increases and non-groove portions are liable to becomes conspicuous and thus viewability of the groove pitch portion on the image increases.

Further, also with regard to the above-described developing sleeve of JP-A 2007-93705, there is a liability that a problem similar to that of the developing sleeve of JP-A Hei02-50182 grooves. That is, the level difference of the unevenness at the recessed portions of the developing sleeve surface is large and the developer feeding power is excessively large, so that unless the SB gap is decreased, the amount of the developer on the developing sleeve becomes large.

SUMMARY OF THE INVENTION

A principal object of the present invention is to provide a developing sleeve and a developing device in which stability of coating of a developer on a developer carrying member is improved without decreasing an interval between the developer carrying member and a regulating member.

According to an aspect of the present invention, there is provided a developing sleeve for carrying a developer containing toner and a carrier, comprising: a plurality of first groove portions provided in a region for carrying the developer, the first groove portions extending in an axial direction of the developing sleeve, wherein each of the first groove portions satisfies D1≥2R and W1≥2R, where 2R is a volume average particle size of the carrier, D1 is a maximum depth of each of the first groove portions and W1 is a width of an opening of each of the first groove portions with respect to a circumferential direction of the developing sleeve, and a plurality of second groove portions provided in a region for carrying the developer, the second groove portions extending in the axial direction of the developing sleeve, wherein each of the second groove portions satisfies D2<2R, where 2R is the volume average particle size of the carrier and D2 is a maximum depth of each of the second groove portions, and wherein each or a plurality of the second groove portions are disposed between associated first groove portions with respect to the circumferential direction of the developing sleeve.

According to another aspect of the present invention, there is provided a developing device comprising: a developing sleeve for carrying a developer containing toner and a carrier; a magnet provided inside the developing sleeve; a plurality of first groove portions provided in a region for carrying the developer on the developing sleeve, the first groove portions extending in an axial direction of the developing sleeve, wherein each of the first groove portions satisfies $D_1 \geq 2R$ and $W_1 \geq 2R$, where 2R is a volume average particle size of the carrier, D1 is a maximum depth of each of the first groove portions and W1 is a width an opening of each of the first groove portions with respect to a circumferential direction of the developing sleeve, and a plurality of second groove portions provided in the region for carrying the developer on the developing sleeve, the second groove portions extending in the axial direction of the developing sleeve, wherein each of the second groove portions satisfies $D_2 < 2R$, where 2R is the volume average particle size of the carrier and D2 is a maximum depth of each of the second groove portions, and wherein each or a plurality of the second groove portions are disposed between associated first groove portions with respect to the circumferential direction of the developing sleeve.

Further features of the present invention will become apparent from the following description of exemplary embodiments with reference to the attached drawings.

DESCRIPTION OF EMBODIMENTS

First Embodiment

In the following, a developing device in the First Embodiment of the present invention will be specifically described with reference to FIGS. 1 to 3. In this embodiment, the developing device is described based on the case where as an example of an image forming apparatus including the developing device, a full-color printer of a tandem type is used. However, the developing device of the present invention is not limited to the developing device for use with the image forming apparatus of the tandem type but may also be a developing device for use with an image forming apparatus of another type. Further, the developing device is not limited to the developing device for use with the full-color image forming apparatus, but may also be a developing device for use with an image forming apparatus for forming a monochromatic image or a mono-color image. Or, the developing device can be carried out in various uses, such as printers, various printing machines, copying machines, facsimile machines and multi-function machines by adding necessary devices, equipment and casing structures or the like. Further, in this embodiment, an image forming apparatus 1 is of a type in which an intermediary transfer belt 44*b* is provided and toner images of respective colors are primary-transferred from photosensitive drums 51 onto the intermediary transfer belt 44*b* and thereafter composite toner images of the respective colors are secondary-transferred altogether from the intermediary transfer belt 44*b* onto a sheet S. However, the image forming apparatus is not limited to the image forming apparatus 1 of the above-described type, but may also employ a type in which a toner image is directly transferred from a photosensitive drum onto a sheet fed by a sheet feeding belt.

Figure 1:
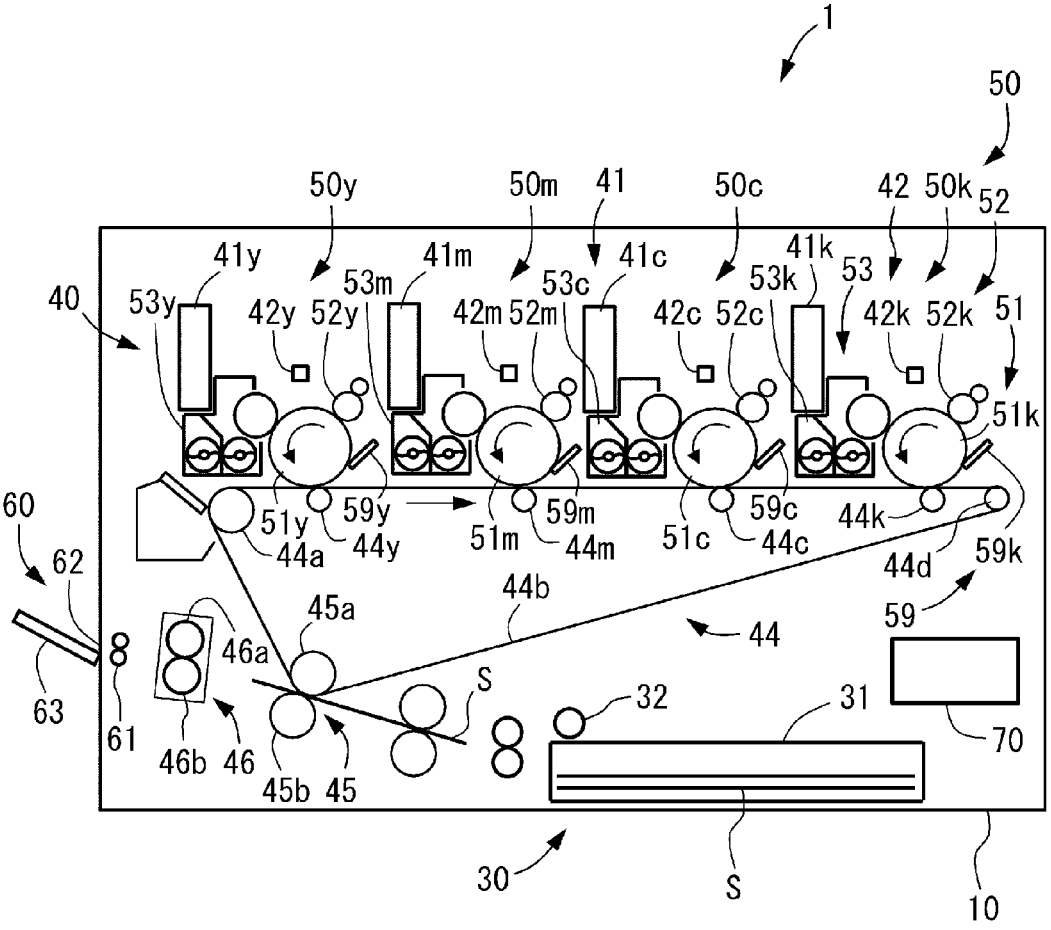
FIG. 1 is a sectional view showing a schematic structure of an image forming apparatus according to a First Embodiment.

As shown in FIG. 1, an image forming apparatus 1 includes an image forming apparatus main assembly 10, a sheet feeding portion 30, an image forming portion 40, an unshown sheet feeding portion, a sheet discharging portion 60, and a controller 70. On the sheet S as a recording material, the toner image is to be formed, and specific examples of the sheet S may include plain paper, a synthetic resin material sheet as a substitute for the plain paper, thick paper, a sheet for an overhead projector, and the like.

The sheet feeding portion 30 is disposed at a lower portion of the apparatus main assembly 10, and includes a sheet cassette 31 for stacking and accommodating the sheet S and includes a feeding roller 32. The sheet feeding portion 30 feeds the sheet S to the image forming portion 40.

The image forming portion 40 includes image forming units 50*y*, 50*m*, 50*c*, 50*k*, toner bottles 41*y*, 41*m*, 41*c*, 41*k*, exposure devices 42*y*, 42*m*, 42*c*, 42*k*, an intermediary transfer unit 44, a secondary transfer portion 45 and a fixing portion 46. The image forming portion 40 is capable of forming an image on the sheet S on the basis of image information. The image forming apparatus 1 in this embodiment is capable of effecting full-color image formation, and the image forming units 50*y*, 50*m*, 50*c*, 50*k* have the same constitution except for the colors of the toners, i.e., yellow (y), magenta (m), cyan (c), black (k), respectively, and are separately provided. For this reason, in FIG. 1, constituent elements of the image forming units for the four colors are represented by suffixes (identifiers) for the colors, but in FIGS. 2 to 4 and in the specification, are described using only reference numerals or symbols without adding the suffixes in some cases.

In this embodiment, as the developer, a two-component developer which is a mixture of non-magnetic toner and a magnetic carrier is used. As the toner, toner having a particle size of 4 μm or more and 10 μm or less is suitable, and in this embodiment, toner used for a color copying machine and having a weight-average particle size of 6 μm is used. When the weight-average particle size of the toner is M and the particle size of the toner is r, in order to form a clearer color image, it is preferable that not only 90 wt. % or more of toner particles are contained in a range of $\frac{1}{2}M<r<\frac{2}{3}M$ but also 99 wt. % or more of the toner particles are contained in a range of $0<r<2M$. As a binder resin used in the toner, it is possible to use a styrene-based copolymer, such as styrene-acrylate resin or styrene-methacrylate resin, or polyester resin. In the case where a color-mixing property during fixing of the color toners is taken into consideration, the polyester resin may preferably be used since the polyester resin has a sharp melting characteristic.

As the carrier, a carrier having an average particle size (50%-particle size: D50) of 25-50 μm on a volume distribution basis may suitably be used, and in this embodiment, a carrier having a volume-average particle size of 25 μm is used. In the following, the particle size of the carrier means the volume-average particle size unless otherwise specified. As particles of the carrier, ferrite particles (Cu—Zn ferrite particles of about 230 emu/cm$^3$ in maximum magnetization) or ferrite particles coated with a resin material in a thin layer may suitably be used. The average particle size (50%-particle size: D50) on the volume distribution basis of the magnetic carrier is measured using, e.g., a multi-image analyzer (manufactured by Beckmann Coulter Inc.) in the following manner.

The particle size distribution was measured by a particle size distribution measuring device of a laser diffraction scattering type ("Microtrac MT3300EX", manufactured by Nikkiso Co., Ltd.). For measurement, a sample supplying machine for identification measurement ("One Shot Dry Sample Conditioner Turbotrac", manufactured by Nikkiso Co., Ltd.) was mounted. A supplying condition of "Turbotrac" was such that a dust collector was used as a vacuum source, an airflow rate was about 33 l/sec, and pressure was 17 kPa. Control is effected automatically on software. As the particle size, the 50%-particle size (D50) which is a cumulative value is obtained. Control and analysis are effected using an attached software (version: 10.3.3-202D). A measuring condition is, for example, as follows:

SetZero Time: 10 sec,
Measuring time: 10 sec,
Number of time of measurement: One,
Particle refractive index: 1.81,
Particle shape: Non-spherical,
Measuring upper limit: 1208 μm,
Measuring lower limit: 0.243 μm, and
Measuring environment: Normal temperature and normal humidity environment (23° C., 50% RH).

As the carrier, a resinous magnetic carrier including a binder resin, a magnetic metal oxide, a non-magnetic metal oxide and the like may also be used. The resinous magnetic carrier has maximum magnetization smaller than that of the ferrite particles, i.e., about 190 emu/cm$^3$. For that reason, a degree of magnetic interaction between adjacent portions of a magnetic brush is small, with the result that chains of the magnetic brush is small, with the result that chains of the magnetic brush are dense and short and thus it is possible to provide an image high in resolution with no density non-uniformity.

The image forming unit 50 includes the four image forming unit is 50*y*, 50*m*, 50*c*, 50*k* for forming toner images of the four colors. Each image forming unit 50 includes a photosensitive drum 51 for forming the toner image, a charging roller 2, a developing device 53 and a regulating blade 59.

The photosensitive drum 51 includes a photosensitive layer formed on an outer peripheral surface of an aluminum cylinder so as to have a negative charge polarity, and is rotated in an arrow direction at a predetermined process speed (peripheral speed). In this embodiment, the photosensitive drum 51 is rotated in the arrow direction at the process speed of 273 mm/sec.

The charging roller 52 contacts the surface of the photosensitive drum 51 and electrically charges the surface of the photosensitive drum 51 to, e.g., a uniform negative dark-portion potential VD. After the charging, the respective surfaces of the photosensitive drums 51 are exposed to light by the exposure devices, so that electrostatic images are formed on the basis of image information. Each of the photosensitive drums 51 carries the formed electrostatic image and is circulated and moved, and the electrostatic image is developed into the toner image with the toner by the developing device 53. Details of a structure of the developing device 53 will be described later.

The toner image is primary-transferred from the photosensitive drum 51 onto the intermediary transfer belt 44*b* described later. The surface of the photosensitive drum 51 after the primary transfer is discharged by an unshown pre-exposure portion. The regulating blade 59 is disposed in contact with the surface of the photosensitive drum 51 and removes a residual matter such as a transfer residual toner remaining on the surface of the photosensitive drum 51 after the primary transfer.

The intermediary transfer unit 44 is disposed below the image forming units 50*y*, 50*m*, 50*c* and 50*k*. The intermediary transfer unit 44 includes a driving roller 44*a*, a follower roller 44*d*, a plurality of primary transfer rollers 44*y*, 44*m*, 44*c* and 44*k*, and the intermediary transfer belt 44*b* wound around the rollers. The primary transfer rollers 44*y*, 44*m*, 44*c* and 44*k* are disposed opposed to the photosensitive drums 51, 51*m*, 51*c* and 51*k*, respectively, and are disposed in contact with the intermediary transfer belt 44*b*.

A positive transfer bias is applied to the intermediary transfer belt 44*b* by the primary transfer rollers 44*y*, 44*m*, 44*c* and 44*k*, whereby toner images having a negative polarity are superposedly transferred successively from the photosensitive drums 51*y*, 51*m*, 51*c* and 51*k* onto the intermediary transfer belt 44*b*. As a result, the toner images obtained by developing the electrostatic images on the surfaces of the photosensitive drums 51*y*, 51*m*, 51*c* and 51*k* are transferred on the intermediary transfer 44*b*, and the intermediary transfer belt 44*b* moves.

The secondary transfer portion 45 includes a secondary transfer inner roller 45*a* and a secondary transfer outer roller 45*b*. By applying a positive secondary transfer bias to the secondary transfer outer roller 45*b*, the full-color image formed on the intermediary transfer belt 44*b* is transferred onto the sheet S. The fixing portion 46 includes a fixing roller 46*a* and a pressing roller 46*a*. The sheet S is nipped and fed between the fixing roller 46*a* and the pressing roller 46*b*, so that the toner image transferred on the sheet S is pressed and heated to be fixed on the sheet S.

The sheet discharging portion 60 includes a discharging roller pair 61 provided in a downstream side of a discharging path, a discharge opening 62 provided at a side portion of the apparatus main assembly, and a discharge tray 63. The discharging roller pair 61 feeds the sheet S, fed from a nip along the discharging path, and is capable of discharging the sheet S through the discharge opening 62. The sheet S discharged through the discharge opening 62 is stacked on the discharge tray 63.

The controller 70 is constituted by a computer and, e.g., includes CPU, ROM for storing a program for controlling respective portions, RAM for temporarily storing data, and an input-and-output circuit for inputting and outputting signals relative to an external device. The CPU is a microprocessor for effecting entire control of the image forming apparatus 1 and is a principal part of a system controller. The CPU is connected via the input-and-output circuit with each of the sheet feeding portion 30, the image forming portion 40, the sheet feeding portion, the sheet discharging portion 60 and an operating portion, and transfers signals with the respective portions and controls operations of the respective portions.

An image forming operation in the image forming apparatus 1 constituted as described above will be described.

When the image forming operation is started, first, the photosensitive drums 51*y*, 51*m*, 51*c* and 51*k* are rotated, and the surfaces thereof are electrically charged by the charging rollers 52*y*, 52*m*, 52*c* and 52*k*, respectively. Then, the exposure devices 42*y*, 42*m*, 42*c*, 42*k* emit, on the basis of image information, laser beams toward the surface of each of the photosensitive drums 51*y*, 51*m*, 51*c* and 51*k*, so that the electrostatic latent images are formed on the surfaces of the photosensitive drums 51*y*, 51*m*, 51*c* and 51*k*. The toners are deposited on the electrostatic latent images to develop (visualize) the electrostatic latent images into toner images, and then the toner images are transferred onto the intermediary transfer belt 44*b*.

On the other hand, in parallel to such a toner image forming operation, the embodiment roller 32 is rotated to feed the uppermost sheet S in a sheet cassette 31 while separating the sheet S. Then, the sheet S is fed to the secondary transfer portion 45 via a feeding path by being timed to the toner image on the intermediary transfer belt 44*b*. Then, the toner image is transferred from the intermediary transfer belt 44*b* onto the sheet S, and the sheet S is fed into the fixing portion 46, in which the (unfixed) toner image is heated and pressed, thus being fixed on the surface of the sheet S. The sheet S is discharged through the discharge opening 62 by the discharging roller pair 61, so that the sheet S is stacked on the discharge tray 63.

The developing device 53 will be specifically described with reference to FIG. 2. The developing device 53 includes a developing container 54 for accommodating a developer D, first and second feeding screws 55 and 56, and a developing sleeve (developer carrying member) 20. The developing container 54 is provided with an opening 54*a* where the developing sleeve 20 is exposed at a position opposing the photosensitive drum 1. In this embodiment, as the developer carrying member, the developing sleeve 20 having a circular shape in cross section is employed, but the present invention is not limited thereto. As the developer carrying member, for example, a belt may also be used.

Into the developing container 54, the toner is supplied from the toner bottle 41 (FIG. 1) in which the toner is filled. The developing container 54 includes a partition wall 57 extending in a longitudinal direction substantially at a central portion. The developing container 54 is partitioned by the partition wall 57 into a developing chamber 54*b* and a stirring chamber 54*c* with respect to a horizontal direction. The developer D is accommodated in the developing chamber 54*b* and the stirring chamber 54*c*. In the developing chamber 54*b*, the developer D is fed to the developing sleeve 20. The stirring chamber 54*c* communicates with the developing chamber 54*b*, and the developer D is collected from the developing sleeve 20 and is stirred.

The first feeding screw 55 is disposed in the developing chamber 54*b* along an axial direction of the developing sleeve 20 and is substantially parallel with the developing sleeve 20. The second feeding screw 56 is disposed in the stirring chamber 54*c* and is substantially parallel with a shaft of the first feeding screw 55, and feeds the developer D in the stirring chamber 54*c* in a direction opposite to a feeding direction of the first feeding screw 55. That is, the developing chamber 54*b* and the stirring chamber 54*c* constitute a circulation path of the developer D along which the developer D is fed while being stirred. The toner is triboelectrically charged to the negative polarity by sliding with the carrier.

At a wall portion of the stirring chamber 54*c*, a toner content (density) detecting sensor 58 (inductance sensor) is provided. The toner content detecting sensor 58 is capable of detecting an amount of the toner in the developing container 54 and sends a detection result to the controller 70 (FIG. 1).

The developing sleeve 20 carries and feeds the developer D including the non-magnetic toner and the magnetic carrier. A developer feeding direction, indicated by an arrow, of the developing sleeve 20 is a rotational direction and is a direction perpendicular to the longitudinal direction. The developing sleeve 20 is constituted by a non-magnetic material such as aluminum or non-magnetic stainless steel, and is constituted in this embodiment by aluminum. Further, in this embodiment, the developing sleeve 20 is 20 mm in diameter, and the shortest interval (gap) of a developing portion 23 which is a region where the developing sleeve 20 and the photosensitive drum 51 are close to and opposite each other is about 300 μm. As a result, the interval is set so that the developer D fed to the developing portion 23 is contacted to the photosensitive drum 51 in a magnetic brush state and thus development can be carried out. That is, in a two-component magnetic brush developing method, the carrier, which is the magnetic material, of the developer is constrained by magnetic flux of the magnet roller 24 during the development and is carried on the surface of the developing sleeve 20. On the surface of the developing sleeve 20, the negatively charged toner is electrostatically constrained by the surface of the positively charged carrier, so that the magnetic brush is formed. Then, the electrostatic latent image is visualized by providing a potential difference between a DC voltage applied to the developing sleeve 20 and the electrostatic latent image on the photosensitive drum 51. In this embodiment, the case where the diameter of the developing sleeve 20 is 20 mm was described, but the present invention is not limited thereto.

The developing sleeve 20 is rotated in the same direction (arrow direction) as a surface movement direction of the photosensitive drum 51 at the developing portion 23, and a peripheral speed ratio thereof to the photosensitive drum 51 is 1.75. The peripheral speed ratio increases development efficiency with an increasing value thereof, but when the peripheral speed ratio is excessively large, toner scattering and developer deterioration and the like generate, and therefore, the peripheral speed ratio may preferably be set between 0.5 and 2.0.

To the developing sleeve 20, in order to improve the development efficiency (ratio of toner impartment to the electrostatic image), a developing voltage in the form of a DC voltage of −500 V biased with an AC voltage of 1300 V in peak-to-peak voltage Vpp and 12 kHz in frequency f is applied. Further, in general, when the AC voltage is applied, the development efficiency increases and thus the image has a high quality, but on the other hand, fog toner on the white background is liable to generate. For this reason, the fog toner on the white background is prevented by providing a potential difference between the DC voltage applied to the developing sleeve 20 and a charge potential (i.e., white background portion potential) of the photosensitive drum 51. Incidentally, a combination of the DC voltage and the AC voltage is not limited to that described above.

Inside the developing sleeve 20, the roller-shaped magnet roller 24 is fixedly provided to the developing container 54 in a non-rotatable state. The magnet roller 24 includes a plurality of magnetic poles N1, S1, N2, S2 and N3 at a surface thereof. The developing pole S2 is disposed opposed to the photosensitive drum 51 at the developing portion 23. The magnetic pole S1 is disposed opposed to the regulating blade 59. The magnetic pole N2 is disposed between the magnetic pole S1 and the developing pole S2. The magnetic pole N1 and the magnetic pole N3 are disposed opposed to the developing chamber 54*b*. In this embodiment, a value of magnetic flux density of the developing pole S2 subjected to the development is 100 mT, and values of magnetic flux density of other magnetic poles are 40 mT-70 mT.

By a developing magnetic field formed at the developing portion 23 by the developing pole S2, the magnetic brush of the developer D is formed at a position substantially opposing the photosensitive drum 1, and develops the electrostatic latent image on the photosensitive drum 51 rotating in an arrow direction in the developing region (portion). The developer D passed through the developing region is fed on the surface of the developing sleeve 20 by the magnetic pole such as the magnetic pole N3 of the magnet roller 24 disposed so that adjacent magnetic poles are different poles, and is scraped off from the surface of the developing sleeve 20 by a repelling magnetic field formed by the magnetic poles N3 and N1. The developer D scraped off from the developing sleeve surface is stirred and fed in the stirring chamber 54*c*, and then is supplied again from the developing chamber 54*b* to the developing sleeve 20.

At an upper portion of the opening 54*a* of the developing container 54, i.e., in a side upstream of the developing portion 23 opposing the photosensitive drum 1 with respect to the rotational direction, the regulating blade 59 is provided. The regulating blade 59 is fixed in a state in which a free end thereof is spaced from the developing sleeve 20 with a predetermined gap, and regulates a layer thickness of the developer D carried on the surface of the developing sleeve 20 by cutting the chains of the magnetic brush of the developer D. The regulating blade 59 is formed with a non-magnetic metal plate (aluminum plate) provided with respect to the longitudinal direction of the developing sleeve 20, and the developer D passes through between the free end portion of the regulating blade 59 and the developing sleeve 20. In this embodiment, a thickness of the regulating blade 59 is 1.2 mm, for example.

By adjusting the gap between the free end of the regulating blade 59 and the surface of the developing sleeve 20, an amount of the developer fed to the developing region while being carried on the developing sleeve 20 is adjusted. In this embodiment, a developer coating amount per unit area on the developing sleeve 20 is adjusted to 0.3 mg/mm$^2$. As the developer coating amount, from the viewpoint of graininess of the image, the developer amount per unit area after passing through the regulating blade 59 may preferably be set in a range of 0.3±0.2 mg/mm$^2$. Further, the gap between the regulating blade 59 and the developing sleeve 20 at that time may preferably be 0.2 mm or more, more preferably be 0.3 mm or more. This is because when the gap between the regulating blade 59 and the developing sleeve 20 is small, the gap is liable to be clogged with a foreign matter or the like and thus there is a possibility that the foreign matter has the influence on the image.

In the case where as the regulating blade 59, a magnetic blade formed with a magnetic plate or a blade prepared by bonding a non-magnetic plate and the magnetic plate together is used, the developer is likely to remain at a position of the magnetic plate by an effect of the magnetic plate, and therefore feeding power of the developer D by the developing sleeve 20 lowers. For this reason, the gap between the regulating blade 59 and the developing sleeve 20 can be made large, but the developer D is liable to stagnate at the magnetic plate position, and therefore, there is a liability that the developer D is liable to deteriorate. For this reason, it is preferable that the gap between the regulating blade 59 and the developing sleeve 20 is increased without using the magnetic blade formed with the magnetic plate or the blade prepared by bonding the non-magnetic plate and the magnetic plate together which are described above to prevent the developer D from stagnating at the magnetic plate position.

In the case where at the surface portion of the developing sleeve 20, grooves or recessed portions (hereinafter referred to as grooves or the like) are provided, feeding power is liable to be higher than feeding power in the case where the grooves or the like are not provided, with the result that the gap between the regulating blade 59 and the developing sleeve 20 is liable to become small. On the other hand, when the feeding power is lowered by decreasing a depth or an opening width of the grooves or the like, the gap between the regulating blade 59 and the developing sleeve 20 can be broadened, but when the feeding power is excessively lowered, there is a liability that a coated state of the developer D on the developing sleeve 20 becomes unstable. Further, the feeding power can be lowered by decreasing the number of the grooves or the like, but in this case, density non-uniformity in pitch of the grooves or the like is liable to appear in the image. Accordingly, it is desired that the gap between the regulating blade 59 and the developing sleeve 20 is broadened while properly maintaining the feeding power.

The gap between the regulating blade 59 and the developing sleeve 20 can be increased by decreasing the depth or the opening width of the grooves or the like, but when the depth or the opening width of the grooves or the like is made excessively small, the feeding power lowers and the coated state of the developer D on the developing sleeve 20 is liable to become unstable. The reason why the coated state of the developer D becomes unstable would be considered that the developer D is not readily caught by the grooves or the like of the developing sleeve 20. In order to stabilize the coated state of the developer D, there is a need that the developer D is caught by the grooves or the like, but in order that the developer D is caught by the grooves or the like, there is a need that the carrier which is a bearer of feeding the developer D is caught by the grooves or the like.

Figure 4:
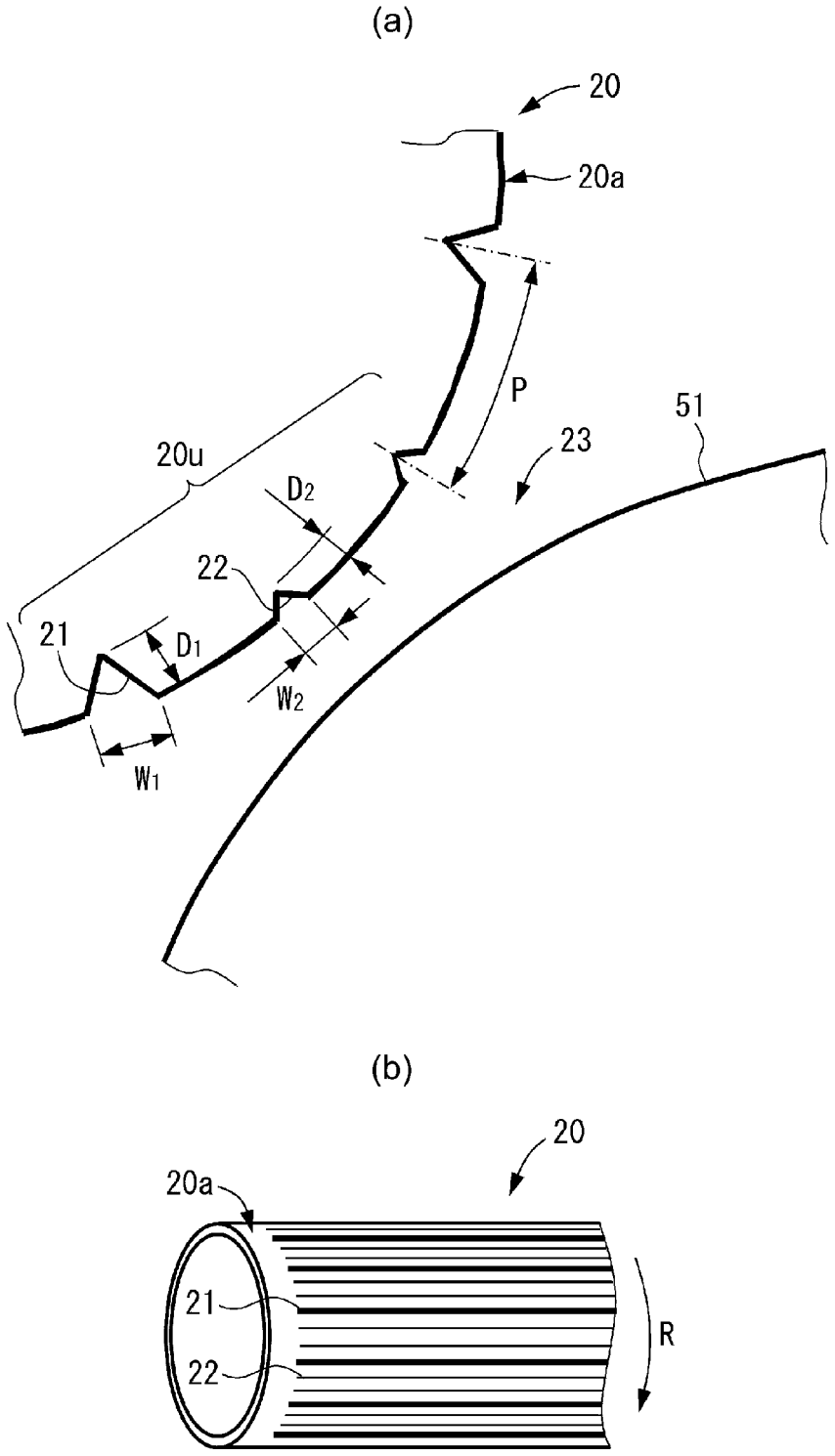
In FIG. 4, (a) is an enlarged sectional view showing a surface portion of the developing sleeve in the First Embodiment, and (b) is a schematic perspective view showing the developing sleeve in the First Embodiment.

Here, grooves 21 and 22 mean not only shapes recessed from a surface 20*a* as shown in, e.g., FIG. 4, but also longitudinal shapes in which recesses continue, and in many cases, mean shapes in which a part thereof is not surrounded by the surface 20*a*. Further, recessed portions 261 and 262 mean not only shapes recessed from a surface 260*a* as shown in, e.g., FIG. 12, but also closed shapes by being surrounded by the surface 260*a* at full circumference.

In the following, the case where the grooves are formed at the surface portion of the developing sleeve 20 will be described. As shown in (a) of FIG. 3, at the surface of the developing sleeve 20, a first groove 21 of $D_1$ in depth and $W_1$ in opening width is formed. Further, as shown in (b) of FIG. 3, at the surface portion of the developing sleeve 20, a second groove 22 of $D_2$ in depth and $W_2$ in opening width is formed. The opening widths $W_1$ and $W_2$ are lengths of the respective grooves 21 and 22 open with respect to a feeding direction R. In this case, a volume-average particle size (diameter) of the carrier is 2R. In this embodiment, each of the grooves 21 and 22 has a V-shape in cross section which is symmetrical with respect to a radius, and inclined angles of inclined surfaces of the grooves 21 and 22 are set at the same value.

In this case, for the purpose of stabilizing the coated state, in order to cause the carrier C of the developer D to be caught by the first groove 21, it is preferable that each of the depth $D_1$ and the opening width $W_1$ is not less than the volume-average particle size 2R of the carrier C. As a result, a degree of catching of the carrier C by the first groove 21 becomes strong (large), so that the coated state of the developer D becomes stable. However, in this case, there is a liability that the gap between the regulating blade 59 and the developing sleeve 20 narrows.

On the other hand, for the purpose of increasing the gap between the regulating blade 59 and the developing sleeve 20, in order to weaken the degree of the catching of the carrier C by the second groove 22, it is preferable that at least one of the depth $D_2$ and the opening width $W_2$ is less than the volume-average particle size 2R of the carrier C. As a result, the degree of the catching of the carrier C by the second groove 22 becomes weak (small), so that the gap between the regulating blade 59 and the developing sleeve 20 can be increased. However, in this case, the coated state of the developer D is liable to become unstable.

Therefore, when only the first grooves 21 are provided and the number of the first grooves 21 is decreased, the gap between the regulating blade 59 and the developing sleeve 20 can be broadened while stabilizing the coated state of the developer D. However, in the case where the number of the first grooves 21 is decreased, there is a liability that the density non-uniformity in pitch of the first grooves 21 is liable to appear on the image. This is because the number of the first grooves 21 is decreased and the developer D is liable to stagnate at the respective grooves 21 in many cases, and thus not only the magnetic chains concentrate at each groove 21 but also an interval between adjacent grooves 21 increases and thus a non-groove portion when there is no groove is liable to become conspicuous. As a result, the image at the groove 21 portion where the magnetic chains concentrate becomes thick in density and the image at the non-groove portion becomes thin in density, so that the image with the density non-uniformity in groove pitch is liable to appear. Particularly, the density non-uniformity in groove pitch is liable to appear when a groove ratio 1 which is represented by a ratio of the sum of the opening widths $W_1$ of the grooves 21 to a circumferential length L of the developing sleeve 20 is 0.1 or less.

On the other hand, as a result of study by the present inventor, a combination of two types of the grooves 21 and 22 which are different in depth and opening width was employed in the present invention. That is, as shown in (a) of FIG. 4, the developing sleeve 20 in this embodiment includes the first grooves 21 (first catching portion) and the second grooves 22 (second catching portion) which are formed at the surface portion of the developing sleeve 20. As shown in (b) of FIG. 4, the first grooves 21 and the second grooves 22 are disposed in parallel with each other at a plurality of positions with respect to a longitudinal direction which is a direction perpendicular to the (developer) feeding direction R, i.e., a direction parallel to a rotational axis.

The first grooves 21 are provided so as to be recessed from the surface 20*a* of the developing sleeve 20 and are capable of catching and feeding the carrier C in the feeding direction R of the developing sleeve 20, and have (carrier) predetermined feeding power with respect to the carrier C. The second grooves 22 are provided so as to be recessed from the surface 20*a* and are capable of catching and feeding the carrier C in the feeding direction R, and have (carrier) feeding power lower than the predetermined feeding power of the carrier C by the first grooves 21. In this embodiment, the first groove 21 satisfies relationships of (depth) $D_1>2R$ and (opening width) $W_1\geq 2R$. The second groove 22 satisfies at least one of relationships of (depth) $D_2<2R$ and (opening width) $W_2<2R$. Incidentally, lengths of the first groove 21 and the second groove 22 with respect to the above-described developing sleeve 20 are equal to each other.

The first grooves 21 and the second grooves 22 are disposed at positions which are regularly repeated with respect to the feeding direction R. In this embodiment, three grooves consisting of a single (one) first groove 21 and two second grooves 22 are repeatedly disposed in the named order with equidistant pitches with respect to the feeding direction R. That is, the number of the first grooves 21 high in feeding power is made relatively small, and instead, the second groove 22 by which the carrier C is not readily caught compared with the first groove 21 and which is low in feeding power is disposed between adjacent first grooves 21.

In this embodiment, the first grooves 21 are substantially equidistantly disposed, and thereafter, the second grooves 22 are regularly disposed between the adjacent first grooves 21 so as to have substantially the same pitch. This is because when an irregular arrangement such that the first grooves 21 concentrate at a single place with respect to a circumferential direction, there is a possibility that density non-uniformity due to irregularity thereof appears on the image formed. For that reason, a unit 20*u* having a combination of the single first groove 21 and the two second grooves 22 may preferably be continuously and repetitively disposed on the developing sleeve 20. In this embodiment, such a shape is repetitively formed over one full circumference of the developing sleeve 20. However, even in the case where at a part of the one full circumference, an arrangement of the grooves is different from the above-described arrangement, e.g., even when there is a portion where the second grooves 22 are removed, it is possible to obtain an effect similar to that of the above-described repetitive arrangement over the one full circumference when the above-described repetitive arrangement is made in a region which is 90% of the one full circumference.

As a result, by the presence of the first grooves 21 high in feeding power, the coated state of the developer can be stabilized as a whole. Further, the gap between the regulating blade 59 and the developing sleeve 20 can be broadened by decreasing the number of the first grooves 21 high in feeding power, and by the presence of the second grooves 22 disposed between the adjacent first grooves 21, the density non-uniformity in groove pitch is able to be not readily generated.

The second grooves 22 satisfy at least one of the relationships of (depth) $D_2>2R$ and (opening width) $W_2<2R$, so that the degree of the catching of the carrier C is weak and the feeding power is low. For that reason, even when the second grooves 22 are provided, it is possible to increase the gap between the regulating blade 59 and the developing sleeve 20. On the other hand, the degree of the catching exists to some extent although it is weak, so that the developer in a certain amount exists also at the non-groove portion, and thus the density non-uniformity in groove pitch is able to be not readily generated. However, when the degree of the catching is excessively weak, an effect of provision of the second grooves 22 is weakened, so that there is a liability that the density non-uniformity in groove pitch is liable to generate. For that reason, the opening width $W_2$ of the second groove 22 may preferably be made larger than ⅓ of the diameter 2R of the carrier C (i.e., =2R/3). Further, also the depth $D_2$ of the second groove 22 may preferably be made larger than ⅓ of the diameter 2R of the magnetic carrier (i.e., =2R/3). That is, the second groove 22 may preferably satisfy at least one of relationships of $2R/3<D_2<2R$ and $2R/3<W_2<2R$.

Further, as regards the second groove 22, when both of the groove width $W_2$ and the groove depth $D_2$ are decreased simultaneously such that the depth $D_2>2R$ and the opening width $W_2<2R$ are satisfied, the degree of the catching of the carrier C becomes excessively weak in some cases. For that reason, the second groove 22 is formed in a shape such that only one of the depth $D_2$ and the opening width $W_2$ is small, whereby a function required for the second groove 22 such that the carrier C is caught although the degree of the catching is weak can be easily satisfied. The shape such that only one of the depth $D_2$ and the opening width $W_2$ is small means a shape satisfying relationships of the depth $D_2>2R$ and the opening width $W_2\geq 2R$ or relationships of the depth $D_2\geq 2R$ and the opening width $W_2<2R$.

The groove ratio $\alpha_1$ of the first groove 21 is represented by a ratio of the sum of opening widths $W_1$ of first groove 21 portions to a circumferential length L of the developing sleeve 20 in cross section. That is, in the case where the number of the first grooves 21 is $n_1$, the sum of the opening widths $W_1$ is represented by $W_1\times n_1$. In this embodiment, a relationship of $0.05\leq W_1\times n_1/L\leq 0.1$ is satisfied. The groove ratio $\alpha_1$ of the first groove 21 is made 0.1 or less, so that the gap between the regulating blade 59 and the developing sleeve 20 can be broadened. Further, when the number of the first grooves 21 high in feeding power is excessively decreased, the coated state of the developer is liable to become unstable, and therefore the groove ratio $\alpha_1$ of the first groove 21 may preferably be 0.05 or more.

A groove ratio $\alpha_2$ of the second groove 22 is represented by a ratio of the sum of opening widths $W_2$ of second groove 22 portions to a circumferential length L of the developing sleeve 20 in cross section. That is, in the case where the number of the second grooves 22 is $n_2$, the sum of the opening widths $W_2$ is represented by $W_2\times n_2$. In this embodiment, a relationship of $0.1\leq(W_1\times n_1/+W_2\times n_2)/L$ is satisfied. The sum of the groove ratio $\alpha_1$ and the carrier $\alpha_2$, i.e., $\alpha_1+\alpha_2$ is made 0.1 or less, so that the number of grooves 22 equal to or larger than the number of the first grooves 21 is employed. That is, when the number of the first grooves 21 is $n_1$ and the number of the second grooves 22 is $n_2$, it is preferable that a relationship of $n_1\leq n_2$ is satisfied. In a further preferred example, a relationship of $n_2/n_1\geq 2$ is satisfied.

The action of the above-described developing sleeve 20 will be described.

Figure 2:
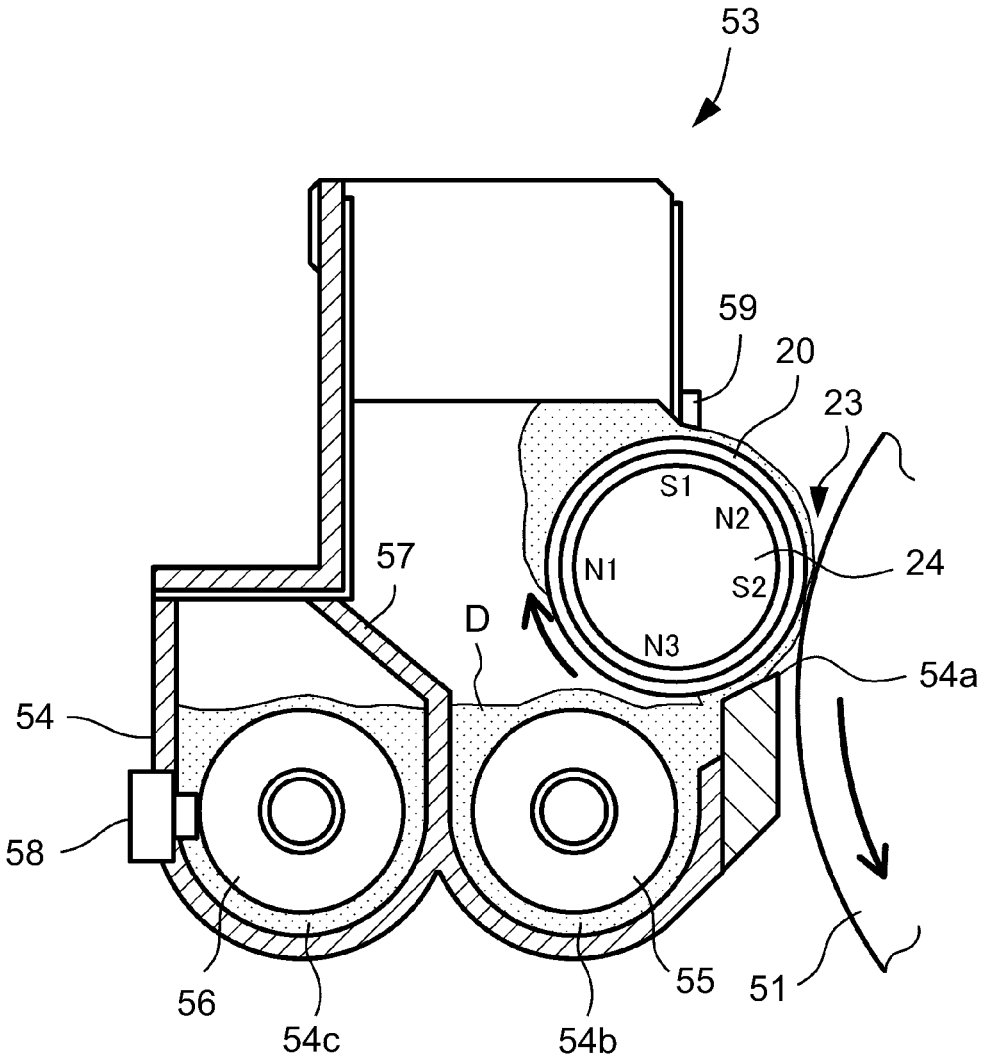
FIG. 2 is a sectional view showing a schematic structure of a developing device in the First Embodiment.
Figure 3:
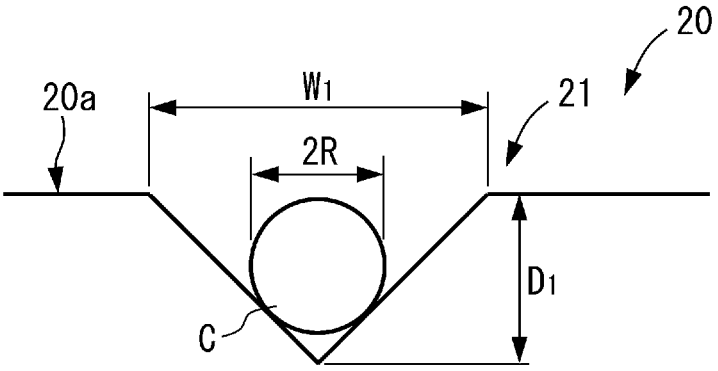
In FIG. 3, (a) and (b) are enlarged sectional views showing a surface portion of a developing sleeve in the First Embodiment, in which (a) shows a first groove, and (b) shows a second groove.
Figure 3:
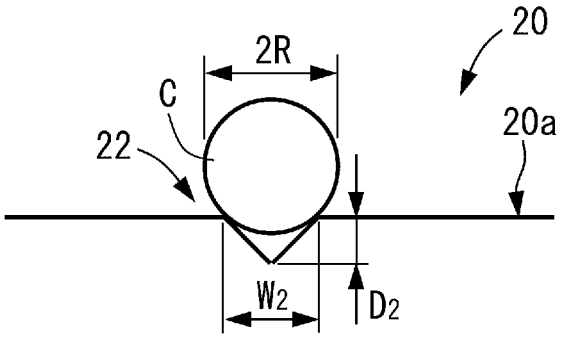

As shown in FIG. 2, the developer D accommodated in the developing chamber 54*b* is stirred and fed by the feeding screw 55, and is carried on the surface of the developing sleeve 20 by a magnetic force of the magnet roller 24. At this time, as shown in (a) and (b) of FIG. 3, at the surface portion of the developing sleeve 20, the carriers C enter the first groove 21 and the second groove 22, so that the magnetic brush is formed. At this time, the first groove 21 satisfies the relationships of the depth $D_1\geq 2R$ and the opening width $W_1>2R$, and therefore the carrier C is strongly caught by the first groove 21, so that the coated state of the developer D is stabilized. Further, the second groove 22 satisfies at least one of the relationships of the depth $D_2<2R$ and the opening width $W_2<2R$, and therefore the degree of the catching of the carrier C by the second groove 22 is weak and thus the feeding power is low, so that it is possible to increase the gap between the regulating blade 59 and the developing sleeve 20. On the other hand, the carrier is caught by the second groove 22 to some extent although the degree of the catching is weak, and therefore the developer exists in a certain amount also at the non-groove portion, so that the density non-uniformity in groove pitch is not readily generated.

The developing sleeve 20 rotates, and the chains of the magnetic brush of the developer D carried on the surface of the developing sleeve 20 are cut by the regulating blade 59 (FIG. 2), so that the layer thickness of the developer D is regulated. Further, the developing sleeve 20 rotates, and the magnetic brush contacts the photosensitive drum 51 (FIG. 2), so that the electrostatic latent image on the photosensitive drum 51 is developed with the toner.

As described above, according to the image forming apparatus 1 in this embodiment, the first grooves 21 and the second grooves 22 lower in feeding power than the first grooves 21 are disposed at positions where these grooves are regularly repeated with respect to the feeding direction R. For this reason, an increase in the number of the first grooves 21 high in feeding power can be suppressed, so that it is possible to avoid necessity of a decrease in gap between the developing sleeve 20 and the regulating blade 59 due to excessively high feeding power. Further, an increase in the number of the second grooves 22 low in feeding power can be suppressed, and therefore it is possible to prevent unstability of coating of the developer D due to excessively low feeding power. Further, the first grooves 21 and the second grooves 22 are disposed repetitively regularly, so that pitches of the grooves 21 and 22 can be set at a proper level and therefore it is possible to suppress generation of density non-uniformity due to the pitches of the grooves 21 and 22.

Further, according to the image forming apparatus 1 in this embodiment, the respective grooves 21 and 22 has a shape such that the grooves extend in parallel to the rotational axis of the developing sleeve 20. For this reason, different from the case where the respective grooves 21 and 22 has a shape such that the grooves extend with an angle other than angles at which the grooves are parallel to the rotational axis of the developing sleeve 20, the first grooves 21 high in feeding power and the second grooves 22 relatively low in feeding power do not cross each other. For this reason, the second grooves 22 can maintain their low feeding power, and therefore it is possible to avoid the necessity of the decrease in gap between the developing sleeve 20 and the regulating blade 59 due to excessively high feeding power.

As regards the image forming apparatus 1 in this embodiment described above, the developing sleeve 20 on which only the two types of the grooves consisting of the first grooves 21 and the second grooves 22 different in dimension were arranged was described, but the present invention is not limited thereto. A developing sleeve on which three types or more of grooves different in dimension may also be used. In that case, with respect to both of the opening width W and the depth D for each of the grooves, when the grooves larger in opening width W and depth D than the particle size (diameter) of the magnetic carrier are collectively regarded as the first grooves and other grooves are collectively regarded as the second grooves, this case can be similarly treated as the case of this embodiment using the two types of the grooves. However, when the opening width or the depth of the groove is smaller than ⅓ of the particle size of the magnetic carrier, the presence of the groove may also be disregarded.

Then, using the image forming apparatus 1 in this embodiment described above, the number $n_1$ and $n_2$, the depths $D_1$ and $D_2$ and the opening widths $W_1$ and $W_2$ of the first grooves 21 and the second grooves 22 were changed and predetermined evaluation items were evaluated for each of the dimensions. As regards the developer used for the evaluation, the above-described developer in which the toner and the magnetic carrier C formed of ferrite were mixed in a ratio of P=0.1 and (1−P)=0.9 as a weight ratio was used. Further, the particle size (diameter) of the carrier C was 35 μm. The evaluation items were a distance of the gap between the developing sleeve 20 and the regulating blade 59 (hereinafter referred to as SB), the coated state of the developer, and the density non-uniformity in groove pitch. Herein, the groove pitch is an average interval between adjacent grooves irrespective of the types of the grooves and is a value obtained by dividing the circumferential length L of the developing sleeve 20 by the number of the sum of the first grooves 21 and the second grooves 22 ($n_1+n_2$). The dimensions in Embodiments 1 to 3 are shown in Table 1 appearing hereinafter, the dimensions in Comparison Examples 1 to 3 are shown in Table 2 appearing hereinafter.

As regards the SB, evaluation was made how the SB when each of the developing sleeves 20 is used is settable in the case where the amount of the developer on the developing sleeve 20 after the developer passed through the regulating blade 59 is set at M/S=0.3 mg/mm$^2$ (=30 mg/cm$^2$). The case where SB=0.2 mm or more cannot be set was evaluated as "x", the case where SB=0.2 mm or more can be set was evaluated as "○", and the case where SB=larger than 0.3 mm can be set was evaluated as "◎". As regards the coated state of the developer, the coated state of the developer was evaluated by eye observation. A state of no coating non-uniformity was evaluated as "◎", and a state in which coating non-uniformity generates and has the influence on the image was evaluated as "x". A state in which slight coating non-uniformity starts to generate although it has no influence on the image was evaluated as "○". As regards the density non-uniformity in groove pitch, the image of about 0.6 in density (OD) was formed and the presence or absence of the density non-uniformity in groove pitch was evaluated. A state of no density non-uniformity was evaluated as "◎", and a state with the density non-uniformity was evaluated as "x". A state in which slight density non-uniformity starts to generate although there is substantially no density non-uniformity was evaluated as "○". Results in Embodiments 1 to 3 are shown in Table 1, and results in Comparison Examples 1 to 3 are shown in Table 2.

TABLE 1

| EMB. | *1 TOG | *2 OW (mm) | *3 D (mm) | *4 GR | *5 AGR | *6 GP (mm) | *7 SB | *8 CS | *9 DN |
|---|---|---|---|---|---|---|---|---|---|
| 1 | 50 | 0.10 | 0.05 | 0.080 | 0.144 | 0.418 | ◎ | ◎ | ◎ |
| | 100 | 0.04 | 0.02 | 0.064 | | | | | |
| 2 | 50 | 0.10 | 0.05 | 0.080 | 0.128 | 0.418 | ◎ | ◎ | ◎ |
| | 100 | 0.03 | 0.04 | 0.048 | | | | | |
| 3 | 50 | 0.10 | 0.05 | 0.080 | 0.128 | 0.418 | ◎ | ◎ | ◎ |
| | 100 | 0.03 | 0.03 | 0.048 | | | | | |

(upper column for *1 to *4): first groove
(lower column for *1 to *4): second groove
*1: "TOG" is the number of grooves.
*2: "OW" is the opening width of the groove.
*3: "D" is the depth of the groove.
*4: "GR" is the groove ratio.

TABLE 1-continued

| EMB. | *1 TOG | *2 OW (mm) | *3 D (mm) | *4 GR | *5 AGR | *6 GP (mm) | *7 SB | *8 CS | *9 DN |
|---|---|---|---|---|---|---|---|---|---|

*5: "AGR" is the all groove ratio.
*6: "GP" is the groove pitch.
*7: "SB" is the SB.
*8: "CS" is the coated state.
*9: "DN" is the density non-uniformity in groove pitch.

Embodiment 1

Figure 5:
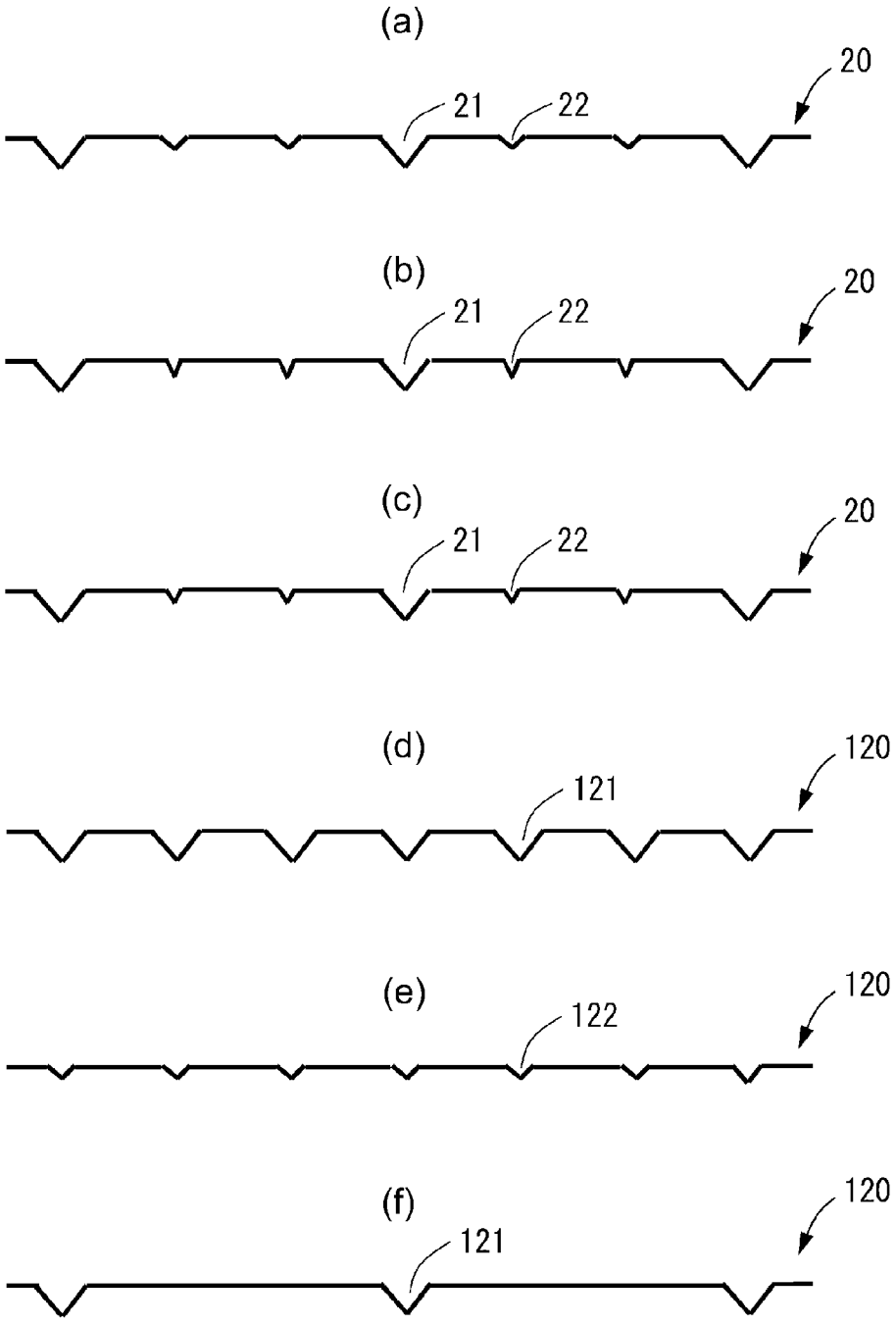
In FIG. 5, (a) to (c) are enlarged sectional views each showing a surface portion of a developing sleeve in the First Embodiment, in which (a) is the surface portion in Embodiment 1, (b) is the surface portion in the Embodiment 2, (c) is the surface portion in Embodiment 3, and (d) to (f) are enlarged sectional views each showing a surface portion of a developing sleeve in Comparison Examples, in which (d) is the surface portion in Comparison Example 1, (e) is the surface portion in Comparison Example 2, and (f) is the surface portion in Comparison Example 3.

As shown in (a) of FIG. 5, the respective dimensions of the first grooves 21 and the second grooves 22 are as follows. The first grooves 21 were 50 (grooves) in number $n_1$ of the grooves, 0.10 mm in opening width $W_1$, 0.05 mm in depth $D_1$ and 0.080 in groove ratio $\alpha_1$. The second grooves 22 were 100 (grooves) in number $n_2$ of the grooves, 0.04 mm in opening width $W_2$, 0.02 mm in depth $D_2$ and 0.064 in groove ratio $\alpha_2$. In this case, the all groove ratio ($\alpha_1+\alpha_2$) was 0.144 and the groove pitch was 0.418 mm. As a result, the groove ratio CI of the first grooves 21 was 0.080 which was 0.1 or less, and therefore the SB was set at 0.35 mm which was not less than 0.3 mm. Further, the coated state was also stable. Further, the all groove ratio ($\alpha_1+\alpha_2$) was 0.144 which was not less than 0.1 and the groove pitch was 0.418 which was small, and therefore the density non-uniformity in groove pitch did not generate.

Embodiment 2

As shown in (b) of FIG. 5, the respective dimensions of the first grooves 21 and the second grooves 22 are as follows. The first grooves 21 were 50 (grooves) in number $n_1$ of the grooves, 0.10 mm in opening width $W_1$, 0.05 mm in depth $D_1$ and 0.080 in groove ratio $\alpha_1$. The second grooves 22 were 100 (grooves) in number $n_2$ of the grooves, 0.03 mm in opening width $W_2$, 0.04 mm in depth $D_2$ and 0.048 in groove ratio $\alpha_2$. In this case, the all groove ratio ($\alpha_1+\alpha_2$) was 0.128 and the groove pitch was 0.418 mm. As a result, the SB and the stability of the coated state were good similarly as in Embodiment 1. Further, the coated state was also stable. Further, the all groove ratio ($\alpha_1+\alpha_2$) was 0.128 which was not less than 0.1 and the groove pitch P was 0.418 which was small, and therefore the density non-uniformity in groove pitch P did not generate.

Embodiment 3

As shown in (c) of FIG. 5, the respective dimensions of the first grooves 21 and the second grooves 22 are as follows. The first grooves 21 were 50 (grooves) in number $n_1$ of the grooves, 0.10 mm in opening width $W_1$, 0.05 mm in depth $D_1$ and 0.080 in groove ratio al. The second grooves 22 were 100 (grooves) in number $n_2$ of the grooves, 0.03 mm in opening width $W_2$, 0.04 mm in depth $D_2$ and 0.048 in groove ratio $\alpha_2$. In this case, the all groove ratio ($\alpha_1+\alpha_2$) was 0.128 and the groove pitch was 0.418 mm. Further, the second grooves 22 satisfied relationships of the depth $D_2<2R$ and the opening width $W_2<2R$. As a result, the SB and the stability of the coated state were good similarly as in Embodiment 1. Further, the coated state was also stable. Further, the all groove ratio ($\alpha_1+\alpha_2$) was 0.128 which was not less than 0.1 and the groove pitch P was 0.418 which was small, and therefore the density non-uniformity in groove pitch P was of no problem, but a state in which slight density non-uniformity start to generate was formed. This is presumably because both of the depth $D_2$ and the opening width $W_2$ are less than the diameter of the carrier C, and therefore the degree of the catching of the carrier C by the second grooves 22 starts to weaken.

TABLE 2

| COMP. EX. | *1 TOG (mm) | *2 OW (mm) | *3 D | *4 GR | *5 AGR | *6 GP (mm) | *7 SB | *8 CS | *9 DN |
|---|---|---|---|---|---|---|---|---|---|
| 1 | 150 | 0.10 | 0.05 | 0.239 | 0.239 | 0.418 | X | ◎ | ◎ |
| | 0 | — | — | — | | | | | |
| 2 | 0 | — | — | — | 0.096 | 0.418 | ◎ | X | ◎ |
| | 150 | 0.04 | 0.02 | 0.096 | | | | | |
| 3 | 50 | 0.10 | 0.05 | 0.080 | 0.080 | 1.256 | ◎ | ◎ | X |
| | 0 | — | — | — | | | | | |

(upper column for *1 to *4): first groove
(lower column for *1 to *4): second groove
*1: "TOG" is the number of grooves.
*2: "OW" is the opening width of the groove.
*3: "D" is the depth of the groove.
*4: "GR" is the groove ratio.
*5: "AGR" is the all groove ratio.
*6: "GP" is the groove pitch.
*7: "SB" is the SB.
*8: "CS" is the coated state.
*9: "DN" is the density non-uniformity in groove pitch.

Comparison Example 1

As shown in (d) of FIG. 5, the respective dimensions of first grooves 121 and are as follows. The first grooves 121 were 150 (grooves) in number $n_1$ of the grooves, 0.10 mm in opening width $W_1$, 0.05 mm in depth $D_1$ and 0.239 in groove ratio al. The second grooves were not formed. In this case, the all groove ratio ($\alpha_1+\alpha_2$) was 0.239 and the groove pitch was 0.418 mm. Further, the first grooves 121 satisfied relationships of the positions $D_1 \geq 2R$ and the opening width $W_1 \geq 2R$. As a result, the SB was able to be merely set at a value less than 0.2 mm. At this time, the coated state was stable, and the density non-uniformity in groove pitch did not generate.

Comparison Example 2

As shown in (e) of FIG. 5, the respective dimensions of second grooves 122 and are as follows. The second grooves 122 were 150 (grooves) in number $n_1$ of the grooves, 0.04 mm in opening width $W_2$, 0.02 mm in depth $D_2$ and 0.096 in groove ratio al. The first grooves were not formed. In this case, the all groove ratio ($\alpha_1+\alpha_2$) was 0.096 and the groove pitch was 0.418 mm. Further, the second grooves 122 satisfied relationships of the positions $D_2<2R$ and the opening width $W_2<2R$. As a result, the SB was able to be set at 0.3 mm or more. On the other hand, the coated state of the developer on the developing sleeve 20 became unstable. This is presumably because both of the depth $D_2$ and the opening width $W_2$ are in a state in which they are not larger than the diameter of the carrier C, and therefore the degree of the catching of the carrier C by the second grooves 22 is weak.

Comparison Example 3

As shown in (f) of FIG. 5, the respective dimensions of first grooves 121 and are as follows. The first grooves 121 were 50 (grooves) in number $n_1$ of the grooves, 0.10 mm in opening width $W_1$, 0.05 mm in depth $D_1$ and 0.080 in groove ratio al. The second grooves were not formed. In this case, the all groove ratio ($\alpha_1+\alpha_2$) was 0.080 and the groove pitch was 1.256 mm. Further, the first grooves 121 satisfied relationships of the positions $D_1 \geq 2R$ and the opening width $W_1 \geq 2R$. As a result, the number of the grooves was decreased compared with Comparison Example 1 and thus the feeding power lowered, and therefore the SB was able to be set at 0.3 mm or more. At this time, the coated state was stable, but on the other hand, the density non-uniformity in groove pitch generated. This is presumably because the all groove ratio lowers and is smaller than 0.1, and therefore, not only the magnetic chains concentrate at the respective grooves but also the groove pitch is increased and therefore the degree of the density non-uniformity in groove pitch becomes worse.

Then, using the image forming apparatus 1 in the First Embodiment described above, similarly as in Embodiments 1 to 3, the numbers $n_1$ and $n_2$, the depths $D_1$ and $D_2$ and the opening widths $W_1$ and $W_2$ of the first grooves 21 and the second grooves 22 were changed, and the predetermined evaluation items in the respective dimensions were evaluated. The dimensions and evaluation results in Embodiments 4 and 5 are shown in Table 3 below, and those in Comparison Examples 4 and 5 are shown in Table 4 appearing hereinafter.

TABLE 3

| EMB. | *1 TOG | *2 OW (mm) | *3 D (mm) | *4 GR | *5 AGR | *6 GP (mm) | *7 SB | *8 CS | *9 DN |
|---|---|---|---|---|---|---|---|---|---|
| 4 | 30 | 0.10 | 0.05 | 0.048 | 0.124 | 0.418 | ◎ | ○ | ◎ |
| | 120 | 0.04 | 0.02 | 0.076 | | | | | |
| 5 | 50 | 0.10 | 0.05 | 0.080 | 0.112 | 0.628 | ◎ | ◎ | ○ |
| | 50 | 0.04 | 0.02 | 0.032 | | | | | |

(upper column for *1 to *4): first groove
(lower column for *1 to *4): second groove
*1: "TOG" is the number of grooves.
*2: "OW" is the opening width of the groove.
*3: "D" is the depth of the groove.
*4: "GR" is the groove ratio.
*5: "AGR" is the all groove ratio.
*6: "GP" is the groove pitch.
*7: "SB" is the SB.
*8: "CS" is the coated state.
*9: "DN" is the density non-uniformity in groove pitch.

Embodiment 4

Figure 6:
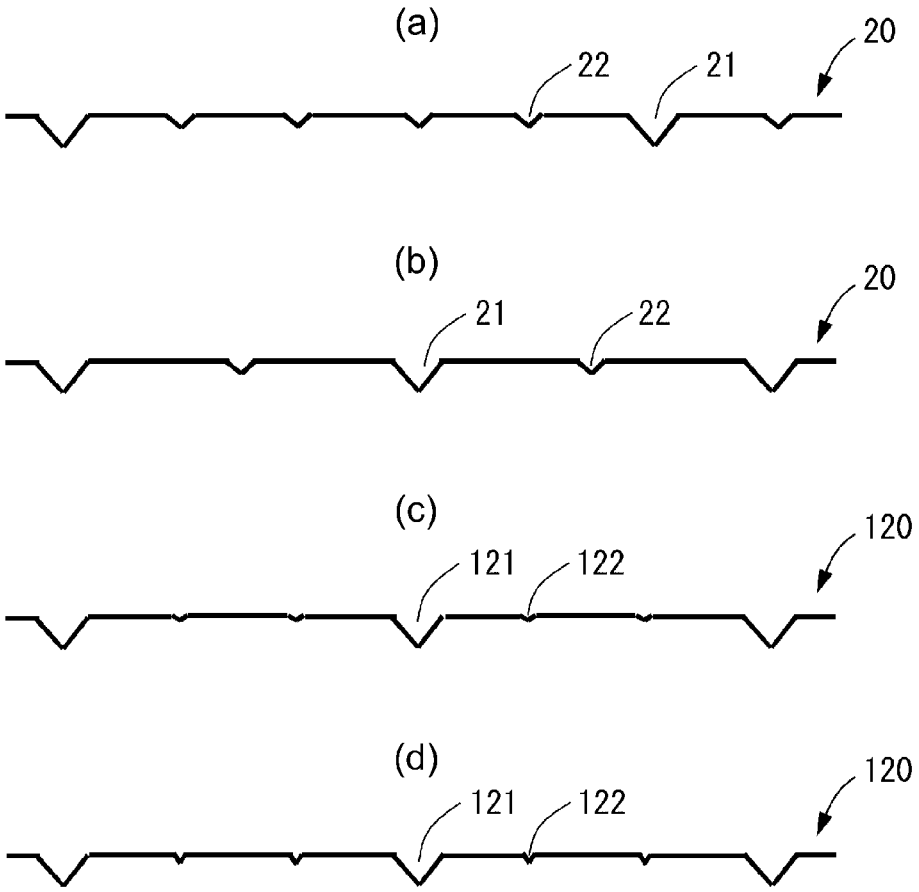
In FIG. 6, (a) and (b) are enlarged sectional views each showing a surface portion of a developing sleeve in the First Embodiment, in which (a) is the surface portion in Embodiment 4 and (b) is the surface portion in Embodiment 5, and (c) and (d) are enlarged sectional views each showing a surface portion of a developing sleeve in Comparison Examples, in which (c) is the surface portion in Comparison Example 4 and (d) is the surface portion in Comparison Example 5.

As shown in (a) of FIG. 6, the respective dimensions of the first grooves 21 and the second grooves 22 are as follows. The first grooves 21 were 30 (grooves) in number $n_1$ of the grooves, 0.10 mm in opening width $W_1$, 0.05 mm in depth $D_1$ and 0.048 in groove ratio al. The second grooves 22 were 120 (grooves) in number $n_2$ of the grooves, 0.04 mm in opening width $W_2$, 0.02 mm in depth $D_2$ and 0.076 in groove ratio $\alpha_2$. In this case, the all groove ratio ($\alpha_1+\alpha_2$) was 0.124 and the groove pitch was 0.418 mm. As a result, the groove ratio $\alpha_1$ of the first grooves 21 was 0.048, and therefore the SB was set at 0.35 mm which was a larger value, but the coated state was a slightly unstable state with a level such that the coated state was not recognized on the image. This is presumably because the number of the first grooves 21 is excessively decreased. Accordingly, the groove ratio $\alpha_1$ of the first grooves 21 in Embodiment 4 was 0.048, but it was confirmed that the groove ratio $\alpha_1$ may preferably be 0.05 or more.

Embodiment 5

As shown in (b) of FIG. 6, the respective dimensions of the first grooves 21 and the second grooves 22 are as follows. The first grooves 21 were 50 (grooves) in number $n_1$ of the grooves, 0.10 mm in opening width $W_1$, 0.05 mm in depth $D_1$ and 0.080 in groove ratio $\alpha_1$. The second grooves 22 were 50 (grooves) in number $n_2$ of the grooves, 0.04 mm in opening width $W_2$, 0.02 mm in depth $D_2$ and 0.032 in groove ratio $\alpha_2$. In this case, the all groove ratio ($\alpha_1+\alpha_2$) was 0.112 and the groove pitch was 0.628 mm. As a result, the SB and the coated state were of no problem, but a state in which the density non-uniformity in groove pitch started to slightly generated was formed. This is presumably because as a result of the decrease in the number of the second grooves 22, the groove pitch increases and thus a state in which the density non-uniformity in groove pitch is liable to somewhat generates is formed. Accordingly, in order to maintain a state in which the density non-uniformity in groove pitch does not generate, it was confirmed that the groove pitch may preferably be kept at 0.5 or less.

TABLE 4

| COMP. EMB. | *1 TOG | *2 OW (mm) | *3 D (mm) | *4 GR | *5 AGR | *6 GP (mm) | *7 SB | *8 CS | *9 DN |
|---|---|---|---|---|---|---|---|---|---|
| 4 | 50 | 0.10 | 0.05 | 0.080 | 0.112 | 0.418 | ◎ | ◎ | X |
| | 100 | 0.02 | 0.01 | 0.032 | | | | | |
| 5 | 50 | 0.10 | 0.05 | 0.080 | 0.104 | 0.418 | ◎ | ◎ | X |
| | 100 | 0.01 | 0.02 | 0.024 | | | | | |

(upper column for *1 to *4): first groove
(lower column for *1 to *4): second groove
*1: "TOG" is the number of grooves.
*2: "OW" is the opening width of the groove.
*3: "D" is the depth of the groove.
*4: "GR" is the groove ratio.
*5: "AGR" is the all groove ratio.
*6: "GP" is the groove pitch.
*7: "SB" is the SB.
*8: "CS" is the coated state.
*9: "DN" is the density non-uniformity in groove pitch.

Comparison Example 4

As shown in (c) of FIG. 6, the respective dimensions of first grooves 121 and second grooves 122 are as follows. The first grooves 121 were 50 (grooves) in number $n_1$ of the grooves, 0.10 mm in opening width $W_1$, 0.05 mm in depth $D_1$ and 0.080 in groove ratio $\alpha_1$. The second grooves 122 were 100 (grooves) in number $n_2$ of the grooves, 0.02 mm in opening width $W_2$, 0.01 mm in depth $D_2$ and 0.032 in groove ratio $\alpha_2$. In this case, the all groove ratio ($\alpha_1+\alpha_2$) was 0.112 and the groove pitch was 0.418 mm. Further, the second grooves 122 satisfied relationships of the depth $D_2<2R$ and the opening width $W_2<2R$. As a result, the SB and the stability of the coated state were good similarly as in Embodiment 3. However, in the developing sleeve 120 in Comparison Example 4, the density non-uniformity in groove pitch generated. This is presumably because the depth $D_2$ of the second grooves 122 is 0.01 mm which is not more than ⅓ of the particle size of the carrier C and thus is made excessively small, and therefore the second grooves 122 do not function. Accordingly, it was confirmed that the depth $D_2$ of the second grooves 122 may preferably be larger than ⅓ of the diameter 2R of the carrier C (i.e., =2R/3).

Comparison Example 5

As shown in (d) of FIG. 6, the respective dimensions of first grooves 121 and second grooves 122 are as follows. The first grooves 121 were 50 (grooves) in number $n_1$ of the grooves, 0.10 mm in opening width $W_1$, 0.05 mm in depth $D_1$ and 0.080 in groove ratio $\alpha_1$. The second grooves 122 were 150 (grooves) in number $n_2$ of the grooves, 0.01 mm in opening width $W_2$, 0.02 mm in depth $D_2$ and 0.024 in groove ratio $\alpha_2$. In this case, the all groove ratio ($\alpha_1+\alpha_2$) was 0.104 and the groove pitch was 0.418 mm. Further, the second grooves 122 satisfied relationships of the depth $D_2<2R$ and the opening width $W_2<2R$. As a result, the SB and the stability of the coated state were good similarly as in Embodiment 3. However, in the developing sleeve 120 in Comparison Example 5, the density non-uniformity in groove pitch generated similarly as in Comparison Example 4. This is presumably because the opening width $W_2$ of the second grooves 122 is 0.01 mm which is not more than ⅓ of the particle size of the carrier C and thus is made excessively small, and therefore the second grooves 122 do not function. Accordingly, it was confirmed that the opening width $W_2$ of the second grooves 122 may preferably be larger than ⅓ of the diameter 2R of the carrier C (i.e., =2R/3).

Second Embodiment

A developing sleeve 200 in the Second Embodiment of the present invention will be specifically described with reference to FIG. 7. The Second Embodiment is different from First Embodiment in that first grooves 201 and second grooves 202 cross each other, but other constituent elements are similar to those in the First Embodiment, and therefore are represented by the same reference numerals or symbols and will be omitted from detailed description. In (a) of FIG. 7, only a part of the respective grooves 201 and 202 is shown.

Figure 7:
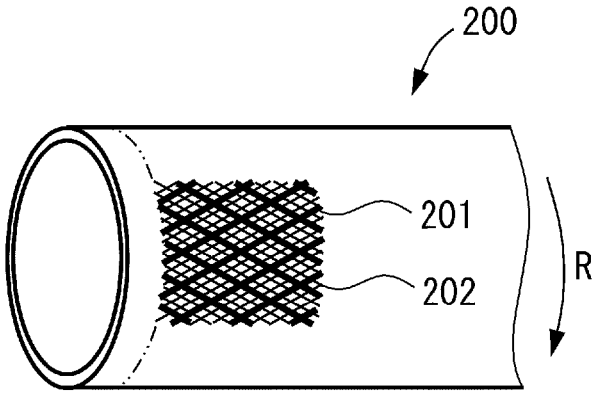
In FIG. 7, (a) is a schematic perspective view showing a developing sleeve in the Second Embodiment, and (b) is a schematic side view showing an arrangement of grooves of the developing sleeve in the Second Embodiment.
Figure 7:
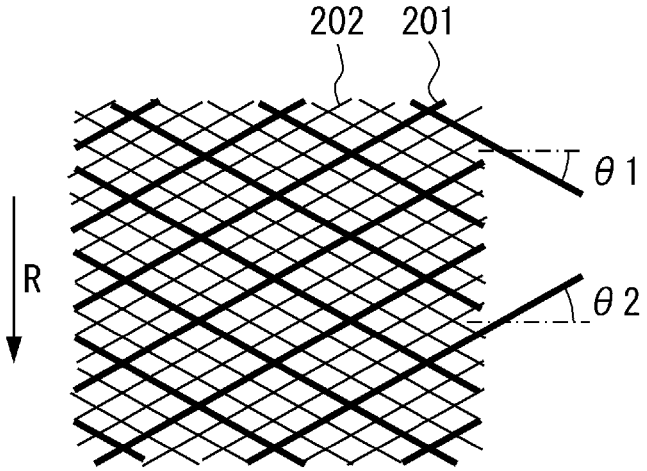

In this embodiment, as shown in (a) of FIG. 7, the developing sleeve 200 includes the first grooves 201 and the second grooves 202. The relationships of the opening widths and the depths of the respective grooves 201 and 202 with the diameter of the carrier are similar to those in the First Embodiment. As shown in (b) of FIG. 7, the first grooves 201 and the second grooves 202 are disposed in a pattern having a so-called double-cut shape such that units each including a plurality of parallel grooves 201 and a plurality of parallel grooves 202 are disposed repetitively so as to form a predetermined angle of about 60°, for example. In this embodiment, the first grooves 201 are 0.10 mm in opening width $W_1$ and 0.05 mm in depth $D_1$, and the second grooves 202 are 0.04 mm in opening width $W_2$ and 0.02 mm in depth $D_2$. Further, the first grooves 201 cross the rotational axis of the developing sleeve 200 with an angle θ1, and the second grooves 202 cross the rotational axis of the developing sleeve 200 with an angle θ2. In this embodiment, θ1-θ2=30°.

The first grooves 201 high in feeding power are 60 grooves in total disposed with certain intervals so that 30 grooves extend right upward and 30 grooves extend right downward. The second grooves 202 low in feeding power are 120 grooves in total disposed with certain intervals so that two second grooves 202 are disposed in parallel between adjacent (two) first grooves 201. The second grooves 202 smaller in opening width W and depth D than the first grooves 201 are disposed, so that even in the case of a double-cut arrangement pattern, an effect similar to that in the First Embodiment is obtained by regularly disposing the two types of the grooves 201 and 202 different in feeding power. As regards the developing sleeve 200 having the double-cut arrangement pattern of the grooves 201 and 202, the grooves 201 and 202 are disposed so as to be inclined with respect to the rotational axis of the developing sleeve 200, and therefore, compared with the case where the two types of the grooves are disposed in parallel to the rotational axis of the developing sleeve, it is possible to weaken the developer feeding power in the rotational direction. For that reason, compared with the developing sleeve having the parallel grooves, the developing sleeve 200 having the double-cut arrangement pattern can be constituted so that the SB is not readily decreased and the grooves 201 and 202 are dense, and therefore groove pitch non-uniformity can be made hard to be generated.

Third Embodiment

A developing sleeve 210 in the Third Embodiment of the present invention will be specifically described with reference to FIG. 8. The Third Embodiment is different from the First Embodiment in that first grooves 211 and second grooves 212 cross each other and in that the opening widths W and the depths D of the first grooves 211 and the second grooves 212 are the same. In the Third Embodiment, other constituent elements are similar to those in the First Embodiment, and therefore are represented by the same reference numerals or symbols and will be omitted from detailed description. In (a) of FIG. 8, only a part of the respective grooves 211 and 212 is shown.

Figure 8:
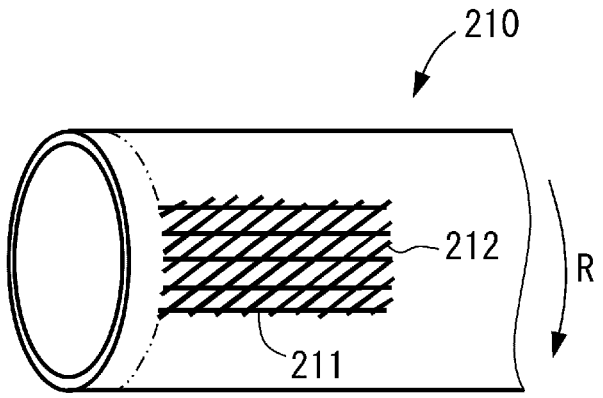
In FIG. 8, (a) is a schematic perspective view showing a developing sleeve in the Third Embodiment, and (b) is a schematic side view showing an arrangement of grooves of the developing sleeve in the Third Embodiment.
Figure 8:
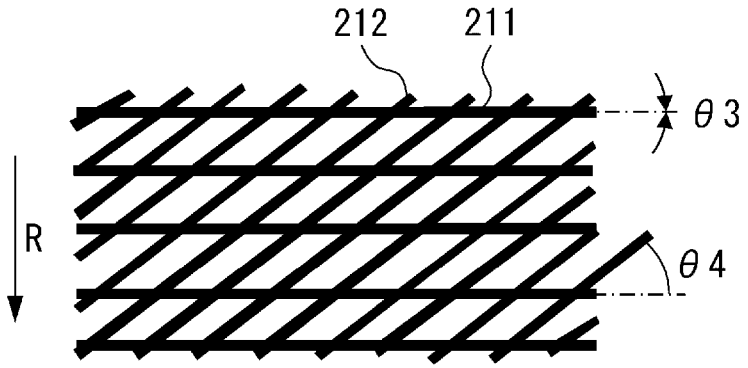

In this embodiment, as shown in (a) of FIG. 8, the developing sleeve 210 includes the first grooves 211 and the second grooves 212. As shown in (b) of FIG. 8, the opening widths W and the depths D of the first grooves 211 and the second grooves 212 are set at the same values, but angles of the first grooves 211 and the second grooves 212 are made different from each other, so that feeding power of the first grooves 211 and feeding power of the second grooves 212 are made different from each other. That is, the first grooves 211 relatively high in feeding power and the second grooves 212 relatively low in feeding power have the same opening width W and the same depth D, but an angle θ3 of the first grooves 211 with respect to a rotational axis of the developing sleeve 210 and an angle θ4 of the second grooves 212 with respect to the rotational axis of the developing sleeve 210 are different from each other. At this time, a relationship of $|\theta 3|<|\theta 4|$ is satisfied.

As regards the developing sleeve 210, both of the first grooves 211 and the second grooves 212 have the same opening width of 0.10 mm and the same depth of 0.05 mm. On the other hand, the angle θ3 of the first grooves 211 with respect to the rotational axis is 0° (parallel to the rotational axis), and the angle θ4 of the second grooves 212 with respect to the rotational axis is 45°. Further, the number of the first grooves 211 is 50, and the number of the second grooves 212 is 60, and the respective first grooves 211 and the respective second grooves 212 are regularly disposed.

In the case where only the first grooves 211 are provided, similarly as in the above-described Comparison Example 3, the density non-uniformity in groove pitch generated, but on the developing sleeve 210 shown in FIG. 8, the second grooves 212 with the angle θ4=45° with respect to the rotational axis are added, so that the density non-uniformity in groove pitch can be eliminated. Further, by the presence of the angle θ4 at which the second grooves 212 are inclined relative to the rotational axis, the feeding power lowers, and therefore the degree of the increase in SB can be decreased. In this embodiment, different from the First Embodiment and the Second Embodiment, a difference in magnitude of the feeding power is provided by changing the angles θ3 and θ4 with respect to the rotational axis while making cross-sectional shapes and dimensions of the grooves 211 and 212 the same. As a result, preparation of the two types of cross-sectional shapes can be made unnecessary, so that a manufacturing step of the developing sleeve 210 can be simplified.

By regularly arranging the two types of the grooves 211 and 212 which have a difference in feeding power, there is a need that the first grooves 211 have the feeding power to some extent in order to obtain an effect similar to that in the First Embodiment. For this reason, the (absolute value of the) angle with respect to the rotational axis may preferable be set in a range of θ3=0-45°. When the angle θ3 is set at a value larger than 45°, the feeding power with respect to the rotational direction cannot be obtained sufficiently. The angle θ3 may preferably be 30° or less. On the other hand, the second grooves 212 are not required to have the feeding power, and therefore, the (absolute value of the) angle with respect to the rotational axis may preferably be set in a range of θ4=30°-70°. When the angle θ4 is smaller than 30°, the feeding power increases, so that the effect similar to that in the First Embodiment cannot be sufficiently obtained in some cases. On the other hand, when the angle θ4 is made larger than 70°, the feeding power became excessively small, so that an effect of providing the second grooves 212 is weakened. For that reason, the angle θ4 may preferably be 70° or less and there is a need to maintain a relationship of θ3-θ4.

Further, in order to obtain the effect by regularly arranging the two types of the grooves 211 and 212 different in feeding power, with respect to the rotational direction, there is a need to always dispose the second groove 212 between the first groove 211 and an adjacent first groove 211. This is because also as described in the First Embodiment, there is a need to dispose the second groove 212 between the adjacent (two) first grooves 211. In order to always dispose the second groove 212 between the first groove 211 and the adjacent first groove 211, the number of the second grooves 212 may only be required to be made larger than the number of the first grooves 211. In the Third Embodiment, the number of the first grooves 211 is 50, and the number of the second grooves 212 is 60, so that the second groove 212 is always present between the first groove 211 and the adjacent first groove 211.

Fourth Embodiment

Figure 9:
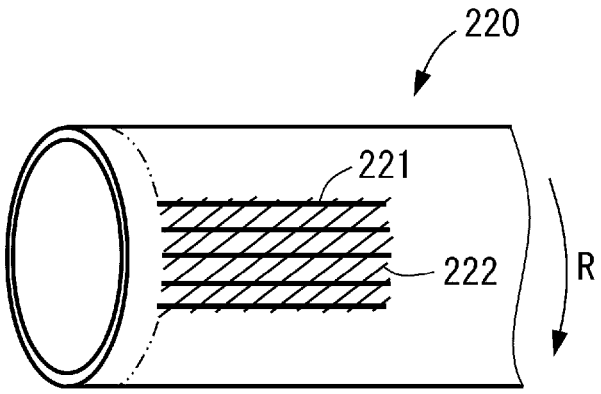
In FIG. 9, (a) is a schematic perspective view showing a developing sleeve in the Fourth Embodiment, and (b) is a schematic side view showing an arrangement of grooves of the developing sleeve in Fourth Embodiment.
Figure 9:
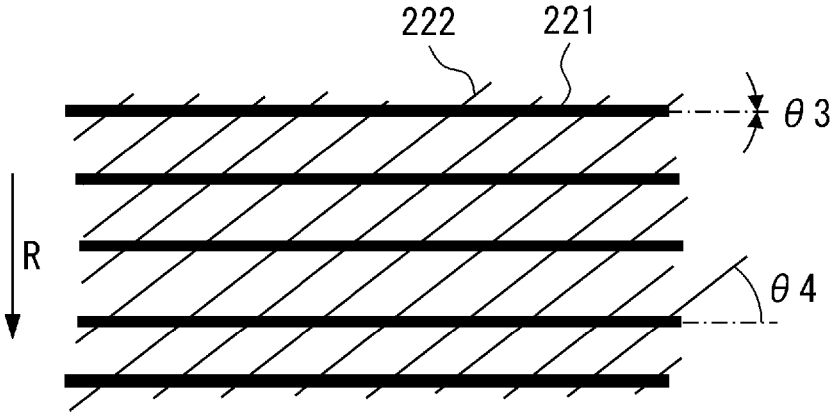

A developing sleeve 220 in the Fourth Embodiment of the present invention will be specifically described with reference to FIG. 9. The Fourth Embodiment is different from the Third Embodiment in that first grooves 221 and second grooves 222 have different opening widths W and depths D, but other constituent elements are similar to those in the Third Embodiment, and therefore are represented by the same reference numerals or symbols and will be omitted from detailed description. In (a) of FIG. 9, only a part of the respective grooves 221 and 222 is shown.

In this embodiment, compared with the developing sleeve 210 shown in FIG. 8, the developing sleeve 220 includes the first grooves 221 having the same values of the angle θ3, the opening width $W_1$, the depth $D_1$, and the number of the grooves as those in the Third Embodiment, but on the other hand, includes the second grooves 222 which have the same angle θ4 but have the opening width $W_2$ of 0.04 mm and the depth $D_2$ of 0.02 mm which are smaller than those in the Third Embodiment, and the number of the second grooves 222 is increased to 120. Compared with the case where the dimensions of the respective grooves 211 and 212 are the same and only the angles are changed as in the Third Embodiment, by changing also the opening widths and the depths of the respective grooves 221 and 222 as in this embodiment, the feeding power of the second grooves 222 can be effectively lowered. However, when the feeding power is excessively small, there is a liability that the effect of regularly arranging the two types of the grooves 221 and 222 having the difference in feeding power cannot be sufficiently obtained. For that reason, similarly as in the First Embodiment, only one of the opening width $W_2$ and the depth $D_2$ of the second grooves 222 may preferably be smaller than the diameter 2R of the magnetic carrier C.

Fifth Embodiment

Figure 10:
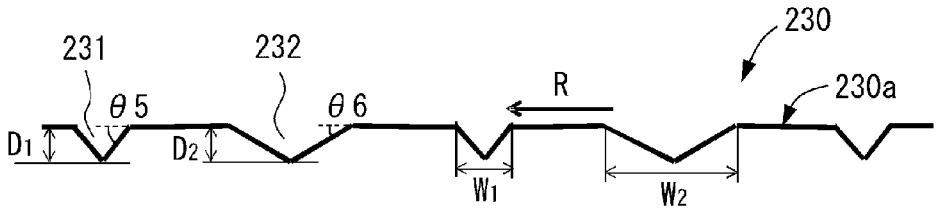
In FIG. 10, (a) is an enlarged sectional view of a surface portion of a developing sleeve in the Fifth Embodiment, and (b) is an enlarged sectional view of a surface portion of a developing sleeve in a Sixth Embodiment.
Figure 10:
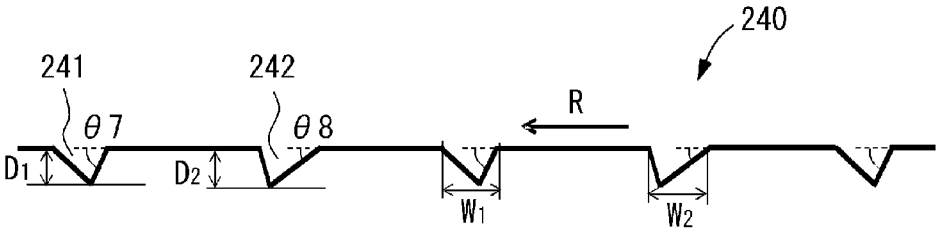

A developing sleeve 230 in the Fifth Embodiment of the present invention will be specifically described with reference to (a) of FIG. 10. The Fifth Embodiment is different from the First Embodiment in that first grooves 231 and second grooves 232 have side surfaces different in inclined angle from each other, but other constituent elements are similar to those in the First Embodiment, and therefore are represented by the same reference numerals or symbols and will be omitted from detailed description.

In this embodiment, the developing sleeve 230 includes the first grooves 231 and the second grooves 232 which are different in cross-sectional shape, particularly in inclined angles θ5 and θ6 at upstream side surface with respect to the feeding direction. That is, the first grooves 231 and the second grooves 232 are made different in feeding power of the carrier C by changing the inclined angles θ5 and θ6 at the upstream side surface with respect to the feeding direction. As a result of study by the present inventor, it turned out that the carrier feeding power by the grooves is influenced by not only the opening widths and the depths of the grooves but also the inclined angles in cross section cut along a plane of the grooves perpendicular to the rotational axis, particularly the inclined angles θ5 and θ6 at the upstream side surfaces with respect to the rotational direction. Here, the inclined angles θ5 and θ6 at the upstream side surfaces with respect to the rotational direction mean angles at which the upstream side surfaces of the grooves are inclined relative to a surface 230*a* of the developing sleeve 230.

In this embodiment, the first grooves 231 having a larger inclined angle is set so as to have the opening width $W_1$ of 0.084 mm, the depth $D_1$ of 0.05 mm and the inclined angle θ5 of 50°, and the number of the first grooves 231 disposed on the developing sleeve 230 is 50. The first grooves 231 is large in inclined angle θ5 at the upstream side surface thereof with respect to the rotational direction, and therefore the feeding power of the carrier C by the first groove 231 is high. On the other hand, the second groove 232 having a smaller inclined angle is set so as to have the opening width $W_2$ of 0.173 mm, the depth $D_2$ of 0.05 mm and the inclined angle θ6 of 30°, and the number of the second grooves 232 disposed regularly between the first grooves 231 on the peripheral surface of the developing sleeve 230 is 50. The second grooves 232 have the small inclined angle θ6 at the upstream side surface thereof with respect to the rotational direction, and therefore, the feeding power of the carrier C by the second grooves 232 is relatively low. Incidentally, each of the grooves 231 and 232 has a cross section which has a symmetrical V-shape, and has an upstream side surface and a downstream side surface, with respect to the rotational direction, which are the same.

In this embodiment, in order to obtain an effect of regularly arranging the two types of the grooves 231 and 232 having the difference in feeding power, the first grooves 231 are required to have the feeding power to some extent, and the inclined angle θ5 may preferably be set in a range of 35°-90° When the inclined angle θ5 is smaller than 35°, the feeding power with respect to the rotational direction cannot be sufficiently obtained. The inclined angle θ5 may preferably be 40° or more. On the other hand, there is no need that the second grooves 232 have the feeding power, and therefore the inclined angle θ6 may preferably be set in a range of 15°-45°. When the inclined angle θ6 is larger than 45°, the feeding power is excessively high, so that there is a liability that the effect cannot be sufficiently obtained. When the inclined angle θ6 is made smaller than 15°, the feeding power is excessively low, so that there is a liability that the effect cannot be sufficiently obtained, and therefore the inclined angle θ6 may preferably be not less than 15°. At this time, there is a need to maintain a relationship of θ5<θ6.

Also in this embodiment, by disposing regularly the two types of the grooves different in feeding power, it is possible to obtain an effect similar to that in the First Embodiment. That is, in the First Embodiment, the feeding power is changed by changing the depths D and the like of the grooves 21 and 22, but in this embodiment, the feeding power is changed by changing the inclined angles of the grooves 231 and 232 at the upstream side surfaces with respect to the rotational direction. In either case, the arrangement of the two types of the grooves different in feeding power is common to the First Embodiment and this embodiment, and therefore similar effects can be obtained.

Sixth Embodiment

A developing sleeve 240 in the Sixth Embodiment of the present invention will be specifically described with reference to (b) of FIG. 10. The Sixth Embodiment is different from the Fifth Embodiment in that first grooves 241 and second grooves 242 have inclined angles, at upstream and downstream side surfaces thereof with respect to the rotational direction, which are different from each other, but other constituent elements are similar to those in the Fifth Embodiment, and therefore are represented by the same reference numerals or symbols and will be omitted from detailed description.

In this embodiment, an inclined angle θ7 of the first grooves 241 at the upstream side surface with respect to the rotational direction and the inclined angle of the first grooves 241 at the downstream side surface with respect to the rotational direction are different from each other, and these side surfaces have an asymmetrical and substantially V-shape in cross section. Further, an inclined angle θ8 of the second grooves 242 at the upstream side surface with respect to the rotational direction and the inclined angle of the second grooves 242 at the downstream side surface with respect to the rotational direction are different from each other, and these side surfaces have an asymmetrical and substantially V-shape in cross section. In these cases, the inclined angle, the opening width and the depth at the upstream side surface with respect to the rotational direction can be independently set, and therefore degree of freedom of design can be improved. Incidentally, as regards the feeding power of the groove, the rotational direction upstream side surface where the catching of the carrier C generate largely contributes to the feeding power, and therefore even when the inclined angle of the rotational direction downstream side surface is different from the inclined angle of the rotational direction upstream side surface, it is possible to obtain an effect similar to that in the First Embodiment.

Seventh Embodiment

Figure 11:
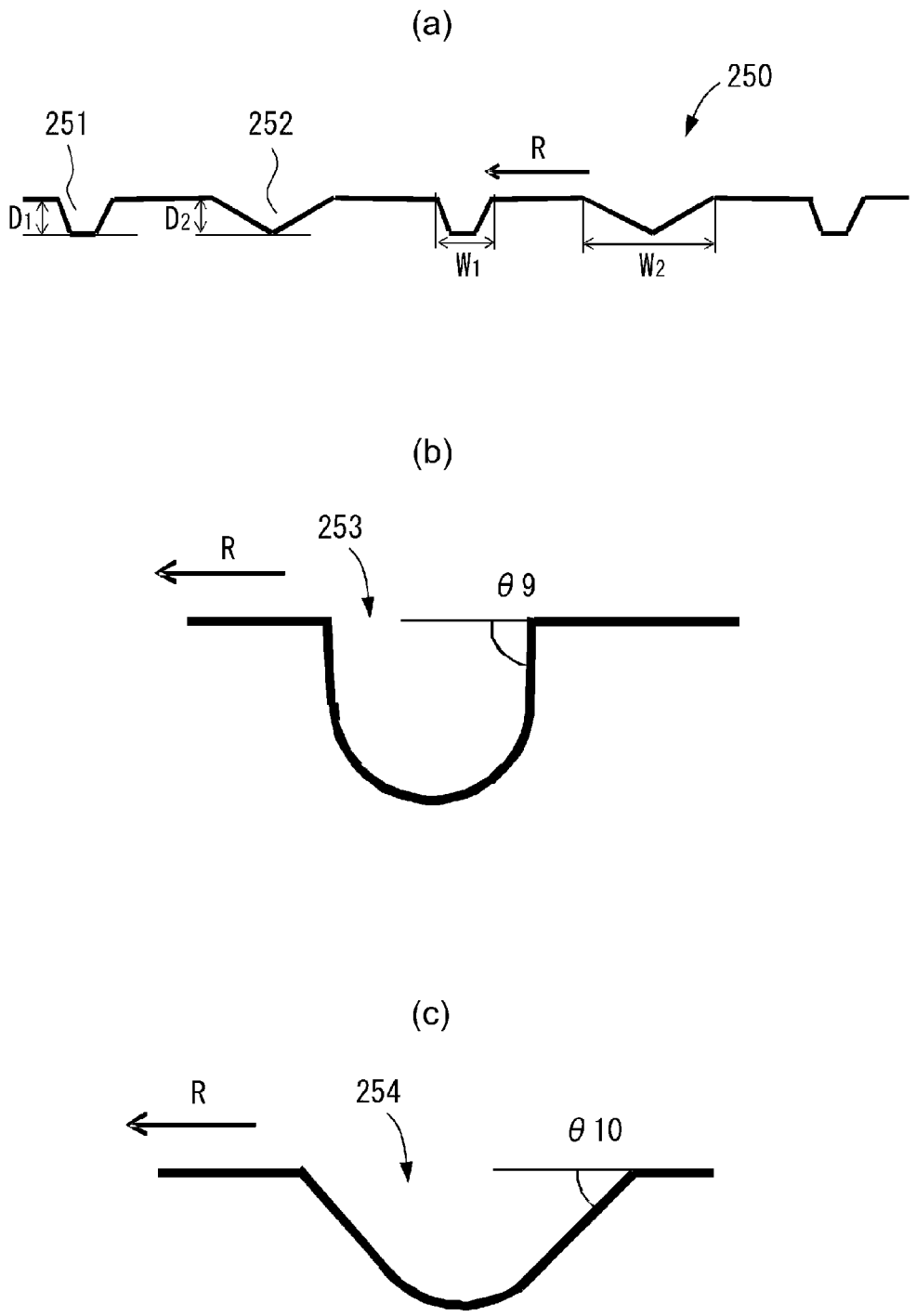
In FIG. 11, (a) to (c) are enlarged sectional views each showing a surface portion of a developing sleeve in a Seventh Embodiment, in which (a) shows first and second grooves, (b) shows a U-shaped groove in cross section, and (c) shows a U-shaped groove in cross section with inclined side surfaces.

A developing sleeve 220 in the Seventh Embodiment of the present invention will be specifically described with reference to (a) of FIG. 11. The Seventh Embodiment is different from the Sixth Embodiment in that first grooves 251 have a trapezoidal shape in cross section, not the V-shape in cross section. Other constituent elements in this embodiment are similar to those in the Fifth Embodiment, and therefore are represented by the same reference numerals or symbols and will be omitted from detailed description. In this embodiment, the second grooves 252 have the symmetrical V-shape in cross section similarly as in the Fifth Embodiment, so that the second grooves 252 have the same inclined angle at the upstream and downstream side surfaces with respect to the rotational direction. The first grooves 241 have the bottom in addition to the upstream and downstream side surfaces with respect to the rotational direction. As regards the first grooves 251, the inclined angles of the upstream and downstream side surfaces with respect to the rotational direction are the same, and the cross section of the first grooves 251 is symmetrical. Also in this case, by regularly arranging the two types of the grooves 251 and 251 different in feeding power, an effect similar to that in the First Embodiment can be obtained.

The groove shape is not limited to the V-shape in cross section and the trapezoidal shape in cross section, but may also be, e.g., a U-shape in cross section or combinations of various shapes. For example, as the grooves, as shown in (b) of FIG. 11, first grooves 253 having a U-shape in cross section such that an inclined angle θ9 thereof at the rotational direction upstream side surface and an inclined angle thereof at the rotational direction downstream side surface are 90° may be used. Further, as shown in (c) of FIG. 11, first grooves 254 having a U-shape in cross section such that an inclined angle θ10 thereof at the rotational direction upstream side surface and an inclined angle thereof at the rotational direction downstream side surface are about 45° may also be used. In either case, as regards the feeding power of the grooves, the rotational direction upstream side surface largely contributes to the feeding power, and therefore even when the inclined angle at the rotational direction downstream side surface is different from the inclined angle at the rotational direction upstream side, it is possible to obtain an effect similar to that in the First Embodiment.

Eight Embodiment

A developing sleeve 260 in the Eight Embodiment of the present invention will be specifically described with reference to FIG. 12. The Eight Embodiment is different from the First Embodiment in that first and second catching portions are recessed portions, not grooves. In this embodiment, other constituent elements are similar to those in the First Embodiment, and therefore are represented by the same reference numerals or symbols and will be omitted from detailed description. In (a) of FIG. 12, only a part of the respective recessed portions 261 and 262 is shown.

Figure 12:
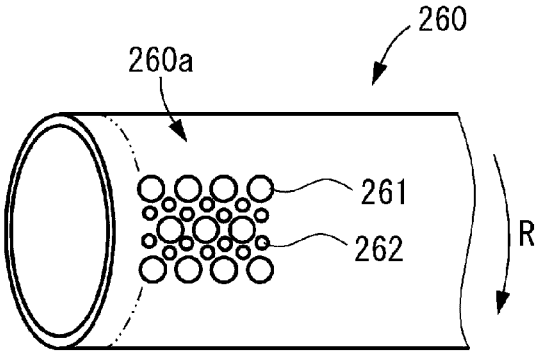
In FIG. 12, (a) is a schematic perspective view showing a developing sleeve in an Eight Embodiment, (b) is an enlarged sectional view showing a surface portion of the developing sleeve in the Eight Embodiment, and (c) is a schematic side view showing an arrangement of recessed portions of the developing sleeve in the Eighth Embodiment.
Figure 12:
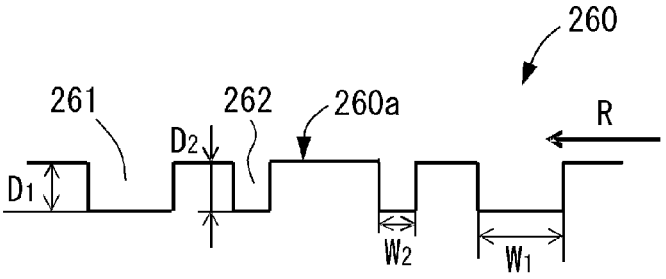
Figure 12:
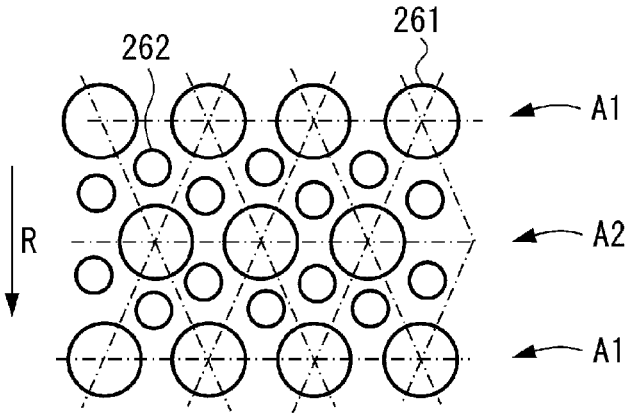

As shown in (a) of FIG. 12, the developing sleeve 260 includes the first recessed portions 261 (first catching portion) and the second recessed portions 262 (second catching portion) which are formed at the surface portion of the developing sleeve 20. The first recessed portions 261 are provided so as to recessed from a surface 260*a* of the developing sleeve 260 and are capable of catching and feeding the carrier C in the feeding direction R of the developing sleeve 260, and have (carrier) predetermined feeding power with respect to the carrier C. The second recessed portions 262 are provided so as to be recessed from the surface 260*a* and are capable of catching and feeding the carrier C in the feeding direction R, and have (carrier) feeding power lower than the predetermined feeding power of the carrier C by the first recessed portions 261.

In this embodiment, the respective rotational directions 261 and 262 have a shape such that an opening shape is a perfect circular shape and each recessed portion has a shape roughly recessed in a cylindrical shape. As shown in (b) of FIG. 12, large-diameter first recessed portions 261 are 0.1 mm in opening width (diameter) $W_1$ and 0.05 mm in depth $D_1$. Small-diameter second grooves 262 are 0.03 mm in opening width (diameter) $W_2$ and 0.05 mm in depth $D_2$. Incidentally, each of the opening widths $W_1$ and $W_2$ is a length of each of the recessed portions 261 and 262 in which each recessed portion opens with respect to the feeding direction R. Compared with the second recessed portions 2622, the first recessed portions 261 are high in feeding power due to a difference in size of the opening. By regularly arranging the respective recessed portions 261 and 262, in combination, different in feeding power, it is possible to obtain an effect similar to that in the First Embodiment.

The relationships of the radius R of the carrier C with the respective opening widths $W_1$ and $W_2$ and the respective depths $D_1$ and $D_2$ are similar to those in the First Embodiment. For example, the opening width $W_1$ of the first recessed portions 261 may preferably be larger than the diameter 2R of the magnetic carrier C, and the opening width $W_1$ of the second recessed portions 262 may preferably be smaller than the diameter 2R of the magnetic carrier C. In this embodiment, the opening width $W_1$ (=0.1 mm) of the first recessed portions 261 is set to be larger than the magnetic carrier diameter (=0.035 mm), and the opening width $W_2$ (=0.03 mm) of the second recessed portions 262 is set to be smaller than the magnetic carrier diameter (=0.035 mm). Thus, by combining the catching portion high in magnetic carrier C feeding power and the catching portion low in magnetic carrier C feeding power, it is possible to obtain an effect similar to that in the First Embodiment. However, the opening width $W_2$ of the second recessed portion 262 may preferably be larger than ⅓ of the magnetic carrier diameter. This is because a lowering in effect of providing the second recessed portions 262 due to an excessive lowering in feeding power is prevented.

As shown in (c) of FIG. 12, as regards an arrangement of the first recessed portions 261, A1 rows in which the first recessed portions 261 linearly disposed along the rotational axis direction with a predetermined interval are disposed with a recessed portion interval with respect to the feeding direction R. Further, between adjacent A1 rows, an A2 row in which the first recessed portion 261 linear disposed along the rotational axis direction with a recessed portion interval is disposed so as to provide a pitch shifted by half from the adjacent A1 rows with respect to the rotational axis direction. That is, the first recessed portions 261 are not only equidistantly disposed linearly with respect to the rotational axis direction (A1 rows in the figure) but also disposed at a position corresponding to an intermediary position therebetween while being moved in the feeding direction R (A2 row in the figure). Thus, the first recessed portions 261 are disposed on the developing sleeve 260 in a hound's-tooth (check) pattern. Further, at a substantially center position of a triangle formed by three adjacent first recessed portions 261 disposed at vertices of the triangle, each of the second recessed portions 262 is disposed. In this manner, by regularly and properly arranging the recessed portions so that the second recessed portions 262 are disposed between the adjacent first recessed portions 261, an effect similar to that in the First Embodiment can be obtained.

Figure 13:
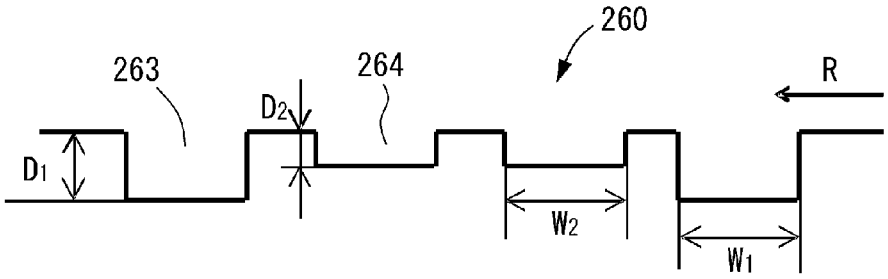
FIG. 13 is an enlarged sectional view showing a surface portion of a developing sleeve in a modified embodiment of the Eight Embodiment.

In the above-described embodiment, the feeding power is changed by changing the opening widths W of the first and second recessed portions 261 and 262 while keeping the same depth D of the first and second recessed portions 261 and 262, but the present invention is not limited thereto. For example, the feeding power may also be changed by changing the depths D of first and second recessed portions 263 and 264 while keeping the same opening width W of the first and second recessed portions 263 and 264. For example, as shown in FIG. 13, the first recessed portions 263 are 0.1 mm in opening width $W_1$ and 0.05 mm in depth $D_1$, and the second recessed portions 264 are 0.1 mm in $W_2$ and 0.02 mm in depth $D_2$. Also in this case, by combining the catching portion high in magnetic carrier C feeding power and the catching portion low in magnetic carrier C feeding power, it is possible to obtain an effect similar to that in the First Embodiment. Further, the depth $D_1$ of the first recessed portions 263 may preferably be larger than the magnetic carrier diameter, and the depth $D_2$ of the second recessed portions 264 may preferably be smaller than the magnetic carrier diameter. However, the depth $D_2$ of the second recessed portion 264 may preferably be larger than ⅓ of the magnetic carrier diameter. This is because a lowering in effect of providing the second recessed portions 264 due to an excessive lowering in feeding power is prevented.

Or, both of the opening widths W and the depths D of the first recessed portions 261 and the second recessed portions 262 may also be made different from each other. However, when the feeding power becomes excessively small, there is a liability that the effect of the present invention is not sufficiently obtained, and therefore, similarly as in the First Embodiment, a constitution in which only one of the opening width $W_2$ and the depth $D_2$ of the second recessed portions is smaller than the magnetic carrier diameter is preferred.

Ninth Embodiment

A developing sleeve 270 in the Ninth Embodiment of the present invention will be specifically described with reference to FIG. 14. The Ninth Embodiment is different from the Eight Embodiment in that first recessed portions 271 and second recessed portions 272 have elliptical shapes, but other constituent elements are similar to those in the Eight Embodiment, and therefore are represented by the same reference numerals or symbols and will be omitted from detailed description. In (a) of FIG. 14, only a part of the respective grooves 271 and 272 is shown.

Figure 14:
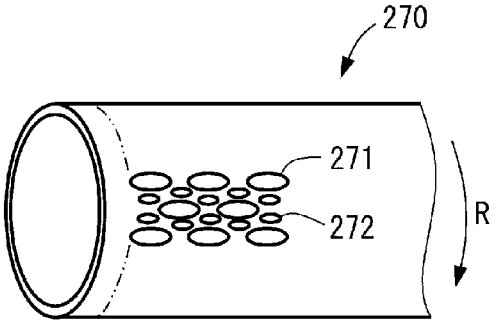
In FIG. 14, (a) is a schematic perspective view showing a developing sleeve in a Ninth Embodiment, and (b) is a schematic side view showing an arrangement of recessed portions of the developing sleeve in the Ninth Embodiment.
Figure 14:
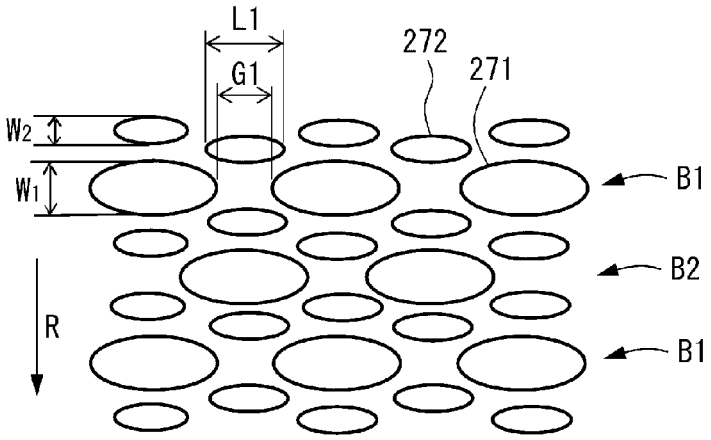

In this embodiment, as shown in (a) of FIG. 14, the developing sleeve 270 includes the first recessed portions 271 and the second recessed portions 272. The respective recessed portions 271 and 272 have the elliptical shapes as the opening shapes and have a shape such that each of the opening shapes is recessed in a roughly cylindrical shape. The respective recessed portions 271 and 272 are disposed so that a short diameter direction is parallel to the feeding direction R. As a result, at least the first recessed portions 271 can obtain high carrier feeding power. The opening width (short diameter of the ellipse) $W_1$ (=0.1 mm) of the first recessed portions 271 is set to be larger than the magnetic carrier C diameter (=0.035 mm), and the opening width (short diameter of the ellipse) $W_2$ (=0.03 mm) of the second recessed portions 262 is set to be smaller than the magnetic carrier C diameter (=0.035 mm).

Further, as shown in (b) of FIG. 14, as regards an arrangement of the first recessed portions 271, B1 rows in which the first recessed portions 271 linearly disposed along the rotational axis direction with a predetermined interval are disposed with a recessed portion interval with respect to the feeding direction R. Further, between adjacent B1 rows, a B2 row in which the first recessed portion 271 are linearly disposed along the rotational axis direction with a recessed portion interval is disposed so as to provide a pitch shifted by half from the adjacent A1 rows with respect to the rotational axis direction. Further, on both sides of the first recessed portions 271 in each row, the second recessed portions 272 are disposed adjacently to the first recessed portion 271. Here, an interval G1 between adjacent first recessed portions 271 with respect to the rotational axis direction is made smaller than a long diameter L1 of an adjacent second recessed portion 272 with respect to the feeding direction R. As a result, between the first recessed portion 271 and the adjacent first recessed portion 271 positioned downstream thereof with respect to the rotational direction, two second recessed portions 272 always exist. Thus, an effect similar to that in the First Embodiment can be obtained.

Incidentally, in the above-described Eighth and Ninth Embodiments, the case where the opening shapes of the recessed portions are the circular or elliptical shape was described, but the present invention is not limited thereto. For example, the opening shapes of the recessed portions may also be a rectangular shape or polygonal shapes or the like.

Tenth Embodiment

Figure 15:
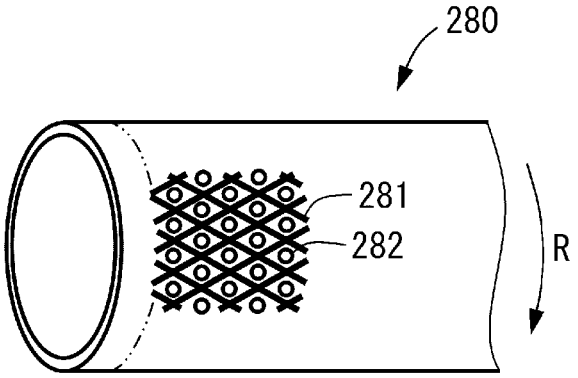
In FIG. 15, (a) is a schematic perspective view showing a developing sleeve in a Tenth Embodiment, and (b) is a schematic side view showing an arrangement of grooves and recessed portions of the developing sleeve in the Tenth Embodiment.
Figure 15:
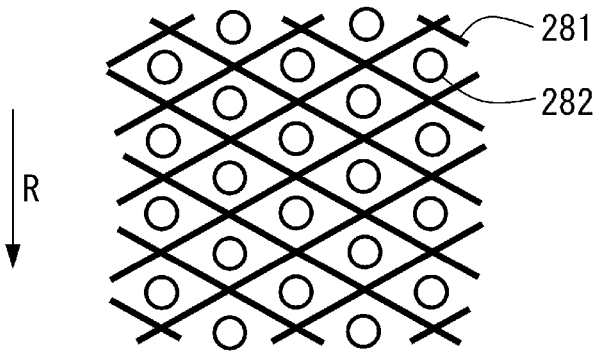

A developing sleeve 280 in the Tenth Embodiment of the present invention will be specifically described with reference to FIG. 15. The Tenth Embodiment is different from the First Embodiment in that the developing sleeve 280 includes first recessed grooves (first catching portions) 281 and second recessed portions (second catching portions) 282. In this embodiment, other constituent elements are similar to those in the First Embodiment, and therefore are represented by the same reference numerals or symbols and will be omitted from detailed description. In (a) of FIG. 15, only a part of the first grooves 281 and the second recessed portions 282 is shown.

The first grooves 281 are disposed in a so-called double-cut pattern so as to cross each other similarly as in the first groove 201 in the Second Embodiment. The second recessed portions 282 are disposed at centers of closed spaces enclosed by the first grooves 281. That is, one of the first and second catching portions is the first grooves 281, and the other of the first and second catching portions in the second recessed portions 282. The first grooves 281 are capable of catching and feeding the carrier C in the feeding direction R of the developing sleeve 280 and have recessed portion feeding power of the carrier C. The second recessed portions 282 are capable of catching and feeding the carrier C in the feeding direction R of the developing sleeve 280 and have feeding power lower than the predetermined feeding power of the carrier C by the first grooves 281. As a result, an effect similar to that in the First Embodiment can be obtained.

In this embodiment, the case where the first catching portions are the grooves and the second catching portions are the recessed portions was described, but the present invention is not limited thereto. For example, a constitution in which the first catching portions are the recessed portions and the second catching portions are the grooves may also be employed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-040383 filed on Mar. 2, 2016, which is hereby incorporated by reference herein in its entirety.

What is claimed is:

1. A developing sleeve for carrying a developer containing toner and a carrier, comprising:

a plurality of first groove portions provided in a region for carrying the developer, said first groove portions extending in an axial direction of said developing sleeve, wherein each of said first groove portions satisfies $D_1 \geq 2R$ and $W_1 \geq 2R$, where 2R is a volume-average particle size of the carrier, $D_1$ is a maximum depth of each of said first groove portions and $W_1$ is a width of an opening of each of said first groove portions with respect to a circumferential direction of said developing sleeve, and a plurality of second groove portions provided in a region for carrying the developer, said second groove portions extending in the axial direction of said developing sleeve, wherein each of said second groove portions satisfies $D_2 < 2R$, where 2R is the volume-average particle size of the carrier and $D_2$ is a maximum depth of each of said second groove portions, and wherein each or a plurality of said second groove portions are disposed between associated first groove portions with respect to the circumferential direction of said developing sleeve.

2. A developing sleeve according to claim 1, wherein each of said second groove portions satisfies $W_2 < 2R$, where $W_2$ is a width of an opening of each of said second groove portions with respect to the circumferential direction of said developing sleeve.

3. A developing sleeve according to claim 1, wherein each of said second groove portions satisfies $2R/3 < D_2 < 2R$.

4. A developing sleeve according to claim 2, wherein each of said second groove portions satisfies $2R/3 < W_2 < 2R$.

5. A developing sleeve according to claim 1, wherein said first groove portions satisfy $W_1 \times n_1/L \leq 0.1$, where Lisa circumferential length of said developing sleeve and $n_1$ is the number of said first groove portions.

6. A developing sleeve according to claim 5, wherein said first groove portions satisfy $0.05 \leq W_1 \times n_1/L$.

7. A developing sleeve according to claim 1, wherein said first groove portions and said second groove portions satisfy $0.1 \leq (W_1 \times n_1 + W_2 \times n_2)/L$, where L is a circumferential length of said developing sleeve, $n_1$ is the number of said first groove portions, $n_2$ is the number of said second groove portions and $W_2$ is a width of an opening of each of said second groove portions with respect to the circumferential direction of said developing sleeve.

8. A developing sleeve according to claim 1, wherein said first groove portions and said second groove portions satisfy $n_1 \geq n_2$, where $n_1$ is the number of said first groove portions and $n_2$ is the number of said second groove portions.

9. A developing sleeve according to claim 2, wherein said first groove portions are disposed in parallel to said second groove portions, and a length of each of said first groove portions is equal to a length of each of said second groove portions with respect to the axial direction.

10. A developing sleeve according to claim 1, wherein each of said first and second groove portions has a V-shape in cross section.

11. A developing sleeve according to claim 1, wherein said first groove portions and said second groove portions are disposed so that an arrangement pattern of said first groove portions and said second groove portions is substantially repeated over one full circumference of said developing sleeve.

12. A developing sleeve for carrying a developer containing toner and a carrier, comprising:

a plurality of first groove portions provided in a region for carrying the developer, said first groove portions extending in an axial direction of said developing sleeve, wherein each of said first groove portions satisfies $D_1 \geq 2R$ and $W_1 \geq 2R$, where 2R is a volume-average particle size of the carrier, $D_1$ is a maximum depth of each of said first groove portions and $W_1$ is a width of an opening of each of said first groove portions with respect to a circumferential direction of said developing sleeve, and a plurality of second groove portions provided in the region for carrying the developer, said second groove portions extending in the axial direction of said developing sleeve, wherein each of said second groove portions satisfies $W_2 < 2R$, where 2R is the volume-average particle size of the carrier and $W_2$ is a width of an opening of each of said second groove portions with respect to the circumferential direction of said developing sleeve, and wherein each or a plurality of said second groove portions are disposed between associated first groove portions with respect to the circumferential direction of said developing sleeve.

13. A developing sleeve according to claim 12, wherein each of said second groove portions satisfies $2R/3 < W_2 < 2R$.

14. A developing sleeve according to claim 12, wherein said first groove portions satisfy $W_1 \times n_1/L \leq 0.1$, where Lisa circumferential length of said developing sleeve and $n_1$ is the number of said first groove portions.

15. A developing sleeve according to claim 14, wherein said first groove portions satisfy $0.05 \leq W_1 \times n_1/L$.

16. A developing sleeve according to claim 12, wherein said first groove portions and said second groove portions satisfy $0.1 \leq (W_1 \times n_1 + W_2 \times n_2)/L$, where L is a circumferential length of said developing sleeve, $n_1$ is the number of said first groove portions and $n_2$ is the number of said second groove portions.

17. A developing sleeve according to claim 12, wherein said first groove portions and said second groove portions satisfy $n_1 \geq n_2$, where $n_1$ is the number of said first groove portions and $n_2$ is the number of said second groove portions.

18. A developing sleeve according to claim 12, wherein said first groove portions are disposed in parallel to said second groove portions.

19. A developing sleeve according to claim 12, wherein each of said first and second groove portions has a V-shape in cross section.

20. A developing sleeve according to claim 12, wherein said first groove portions and said second groove portions are disposed so that an arrangement pattern of said first groove portions and said second groove portions is substantially repeated over one full circumference of said developing sleeve.

21. A developing sleeve for carrying a developer containing toner and a carrier, comprising:

a plurality of first recessed portions provided in a region for carrying the developer, wherein each of said first recessed portions satisfies $D_1 \geq 2R$ and $W_1 \geq 2R$, where 2R is a volume-average particle size of the carrier, $D_1$ is a maximum depth of each of said first recessed portions and $W_1$ is a width of an opening of each of said first recessed portions with respect to a circumferential direction of said developing sleeve, and a plurality of second recessed portions provided in the region for carrying the developer, wherein each of said second recessed portions satisfies $2R/3 < D_2 < 2R$, where 2R is the volume-average particle size of the carrier and $D_2$ is a maximum depth of each of said second recessed portions, and wherein each or a plurality of said second recessed portions are disposed between associated first recessed portions with respect to the circumferential direction of said developing sleeve.

22. A developing sleeve according to claim 21, wherein each of said second recessed portions satisfies $2R/3 < W_2 < 2R$, where $W_2$ is a width of an opening of each of said second recessed portions with respect to the circumferential direction of said developing sleeve.

23. A developing sleeve according to claim 21, wherein said first recessed portions satisfy $0.05 \leq W_1 \times n_1/L \leq 0.1$, where Lisa circumferential length of said developing sleeve and $n_1$ is the number of said first recessed portions.

24. A developing sleeve according to claim 21, wherein said first recessed portions and said second recessed portions satisfy $0.1 \leq (W_1 \times n_1 + W_2 \times n_2)/L$, where L is a circumferential length of said developing sleeve, $n_1$ is the number of said recessed groove portions, $n_2$ is the number of said second recessed portions and $W_2$ is a width of an opening of each of said second recessed portions with respect to the circumferential direction of said developing sleeve.

25. A developing sleeve according to claim 21, wherein said first recessed portions and said second recessed portions satisfy $n_1 \geq n_2$, where $n_1$ is the number of said first recessed portions and $n_2$ is the number of said second recessed portions.

26. A developing sleeve according to claim 21, wherein said first recessed portions and said second recessed portions are disposed so that an arrangement pattern of said first recessed portions and said second recessed portions is substantially repeated over one full circumference of said developing sleeve.

27. A developing sleeve for carrying a developer containing toner and a carrier, comprising:

a plurality of first recessed portions provided in a region for carrying the developer, wherein each of said first recessed portions satisfies $D_1 \geq 2R$ and $W_1 \geq 2R$, where 2R is a volume-average particle size of the carrier, $D_1$ is a maximum depth of each of said first recessed portions and $W_1$ is a width of an opening of each of said first recessed portions with respect to a circumferential direction of said developing sleeve, and a plurality of second recessed portions provided in the region for carrying the developer, wherein each of said second recessed portions satisfies $2R/3<W_2<2R$, where 2R is the volume-average particle size of the carrier and $W_2$ is a width of an opening of each of said second recessed portions with respect to the circumferential direction of said developing sleeve, and wherein each or plurality of said second recessed portions are disposed between associated first recessed portions with respect to the circumferential direction of said developing sleeve.

28. A developing sleeve according to claim 27, wherein said first recessed portions satisfy $0.05\leq W_1\times n_1/L\leq 0.1$, where Lisa circumferential length of said developing sleeve and $n_1$ is the number of said first recessed portions.

29. A developing sleeve according to claim 27, wherein said first recessed portions and said second recessed portions satisfy $0.1\leq(W_1\times n_1+W_2\times n_2)/L$, where L is a circumferential length of said developing sleeve, $n_1$ is the number of said recessed groove portions and $n_2$ is the number of said second recessed portions.

30. A developing sleeve according to claim 27, wherein said first recessed portions and said second recessed portions satisfy $n_1\geq n_2$, where n1 is the number of said first recessed portions and $n_2$ is the number of said second recessed portions.

31. A developing sleeve according to claim 27, wherein said first recessed portions and said second recessed portions are disposed so that an arrangement pattern of said first recessed portions and said second recessed portions is substantially repeated over one full circumference of said developing sleeve.

32. A developing device comprising:

a developing sleeve for carrying a developer containing toner and a carrier;

a magnet provided inside said developing sleeve;

a plurality of first groove portions provided in a region for carrying the developer on said developing sleeve, said first groove portions extending in an axial direction of said developing sleeve, wherein each of said first groove portions satisfies $D_1\geq 2R$ and $W_1\geq 2R$, where 2R is a volume-average particle size of the carrier, $D_1$ is a maximum depth of each of said first groove portions and $W_1$ is a width of an opening of each of said first groove portions with respect to a circumferential direction of said developing sleeve, and a plurality of second groove portions provided in the region for carrying the developer on said developing sleeve, said second groove portions extending in the axial direction of said developing sleeve, wherein each of said second groove portions satisfies $D_2<2R$, where 2R is the volume-average particle size of the carrier and $D_2$ is a maximum depth of each of said second groove portions, and wherein each or a plurality of said second groove portions are disposed between associated first groove portions with respect to the circumferential direction of said developing sleeve.

33. A developing device according to claim 32, wherein each of said second groove portions satisfies $W_2<2R$, where $W_2$ is a width of an opening of each of said second groove portions with respect to the circumferential direction of said developing sleeve.

34. A developing device according to claim 32, wherein each of said second groove portions satisfies $2R/3<D_2<2R$.

35. A developing device according to claim 33, wherein each of said second groove portions satisfies $2R/3<W_2<2R$.

36. A developing device according to claim 32, wherein said first groove portions satisfy $W_1\times n_1/L\leq 0.1$, where Lisa circumferential length of said developing sleeve and $n_1$ is the number of said first groove portions.

37. A developing device according to claim 36, wherein said first groove portions satisfy $0.05\leq W_1\times n_1/L$.

38. A developing device according to claim 32, wherein said first groove portions and said second groove portions satisfy $0.1\leq(W_1\times n_1+W_2\times n_2)/L$, where L is a circumferential length of said developing sleeve, $n_1$ is the number of said first groove portions, $n_2$ is the number of said second groove portions and is $W_2$ a width of an opening of each of said second groove portions with respect to the circumferential direction of said developing sleeve.

39. A developing device according to claim 32, wherein said first groove portions and said second groove portions satisfy $n_1\geq n_2$, where $n_1$ is the number of said first groove portions and $n_2$ is the number of said second groove portions.

40. A developing device according to claim 32, wherein said first groove portions are disposed in parallel to said second groove portions, and a length of each of said first groove portions is equal to a length of each of said second groove portions with respect to the axial direction.

41. A developing device according to claim 32, wherein each of said first and second groove portions has a V-shape in cross section.

42. A developing device according to claim 32, wherein said first groove portions and said second groove portions are disposed so that an arrangement pattern of said first groove portions and said second groove portions is substantially repeated over one full circumference of said developing sleeve.

43. A developing device comprising:

a developing sleeve for carrying a developer containing toner and a carrier;

a magnet provided inside said developing sleeve;

a plurality of first groove portions provided in a region for carrying the developer on said developing sleeve, said first groove portion extending in an axial direction of said developing sleeve, wherein each of said first groove portions satisfies $D_1\geq 2R$ and $W_1\geq 2R$, where 2R is a volume-average particle size of the carrier, $D_1$ is a maximum depth of each of said first groove portions and $W_1$ is a width of an opening of each of said first groove portions with respect to a circumferential direction of said developing sleeve, and a plurality of second groove portions provided in the region for carrying the developer on said developing sleeve, said second groove portions extending in the axial direction of said developing sleeve, wherein each of said second groove portions satisfies $W_2<2R$, where 2R is the volume-average particle size of the carrier and $W_2$ is a width of an opening of each of said second groove portions with respect to the circumferential direction of said developing sleeve, and wherein each or a plurality of said second groove portions are disposed between associated first groove portions with respect to the circumferential direction of said developing sleeve.

44. A developing device according to claim 43, wherein each of said second groove portions satisfies $2R/3<W_2<2R$.

45. A developing device according to claim 43, wherein said first groove portions satisfy $W_1\times n_1/L\leq 0.1$, where Lisa circumferential length of said developing sleeve and $n_1$ is the number of said first groove portions.

46. A developing device according to claim 45, wherein said first groove portions satisfy $0.05 \leq W_1 \times n_1/L$.

47. A developing device according to claim 43, wherein said first groove portions and said second groove portions satisfy $0.1 \leq (W_1 \times n_1 + W_2 \times n_2)/L$, where L is a circumferential length of said developing sleeve, $n_1$ is the number of said first groove portions and $n_2$ is the number of said second groove portions.

48. A developing device according to claim 43, wherein said first groove portions and said second groove portions satisfy $n_1 \geq n_2$, where $n_1$ is the number of said first groove portions and $n_2$ is the number of said second groove portions.

49. A developing device according to claim 43, wherein said first groove portions are disposed in parallel to said second groove portions.

50. A developing device according to claim 43, wherein each of said first and second groove portions has a V-shape in cross section.

51. A developing device according to claim 43, wherein said first groove portions and said second groove portions are disposed so that an arrangement pattern of said first groove portions and said second groove portions is substantially repeated over one full circumference of said developing sleeve.

52. A developing device comprising:

a developing sleeve for carrying a developer containing toner and a carrier;

a magnet provided inside said developing sleeve;

a plurality of first recessed portions provided in a region for carrying the developer on said developing sleeve, wherein each of said first recessed portions satisfies $D_1 \geq 2R$ and $W_1 \geq 2R$, where 2R is a volume-average particle size of the carrier, $D_1$ is a maximum depth of each of said first recessed portions and $W_1$ is a width of an opening of each of said first recessed portions with respect to a circumferential direction of said developing sleeve, and a plurality of second recessed portions provided in the region for carrying the developer on said developing sleeve, wherein each of said second recessed portions satisfies $2R/3 < D_2 < 2R$, where 2R is the volume-average particle size of the carrier and $D_2$ is a maximum depth of each of said second recessed portions, and wherein each or a plurality of said second recessed portions are disposed between associated first recessed portions with respect to the circumferential direction of said developing sleeve.

53. A developing device according to claim 52, wherein each of said second recessed portions satisfies $2R/3 < W_2 < 2R$, where $W_2$ is a width of an opening of each of said second recessed portions with respect to the circumferential direction of said developing sleeve.

54. A developing device according to claim 52, wherein said first recessed portions satisfy $0.05 \leq W_1 \times n_1/L \leq 0.1$, where Lisa circumferential length of said developing sleeve and $n_1$ is the number of said first recessed portions.

55. A developing device according to claim 52, wherein said first recessed portions and said second recessed portions satisfy $0.1 \leq (W_1 \times n_1 + W_2 \times n_2)/L$, where L is a circumferential length of said developing sleeve, $n_1$ is the number of said recessed groove portions, $n_2$ is the number of said second recessed portions and $W_2$ is a width of an opening of each of said second recessed portions with respect to the circumferential direction of said developing sleeve.

56. A developing device according to claim 52, wherein said first recessed portions and said second recessed portions satisfy $n_1 \geq n_2$, where $n_1$ is the number of said first recessed portions and $n_2$ is the number of said second recessed portions.

57. A developing device according to claim 52, wherein said first recessed portions and said second recessed portions are disposed so that an arrangement pattern of said first recessed portions and said second recessed portions is substantially repeated over one full circumference of said developing sleeve.

58. A developing device comprising:

a developing sleeve for carrying a developer containing toner and a carrier;

a magnet provided inside said developing sleeve;

a plurality of first recessed portions provided in a region for carrying the developer on said developing sleeve, wherein each of said first recessed portions satisfies $D_1 \geq 2R$ and $W_1 \geq 2R$, where 2R is a volume-average particle size of the carrier, $D_1$ is a maximum depth of each of said first recessed portions and $W_1$ is a width of an opening of each of said first recessed portions with respect to a circumferential direction of said developing sleeve, and a plurality of second recessed portions provided in the region for carrying the developer on said developing sleeve, wherein each of said second recessed portions satisfies $2R/3 < W_2 < 2R$, where 2R is the volume-average particle size of the carrier and $W_2$ is a width of an opening of each of said second recessed portions with respect to the circumferential direction of said developing sleeve, and wherein each or a plurality of said second recessed portions are disposed between associated first recessed portions with respect to the circumferential direction of said developing sleeve.

59. A developing device according to claim 58, wherein said first recessed portions satisfy $0.05 \leq W_1 \times n_1/L \leq 0.1$, where L is a circumferential length of said developing sleeve and $n_1$ is the number of said first recessed portions.

60. A developing device according to claim 58, wherein said first recessed portions and said second recessed portions satisfy $0.1 \leq (W_1 \times n_1 + W_2 \times n_2)/L$, where L is a circumferential length of said developing sleeve, $n_1$ is the number of said recessed groove portions and $n_2$ is the number of said second recessed portions.

61. A developing device according to claim 58, wherein said first recessed portions and said second recessed portions satisfy $n_1 \geq n_2$, where $n_1$ is the number of said first recessed portions and $n_2$ is the number of said second recessed portions.

62. A developing device according to claim 58, wherein said first recessed portions and said second recessed portions are disposed so that an arrangement pattern of said first recessed portions and said second recessed portions is substantially repeated over one full circumference of said developing sleeve.

* * * * *